US011653745B2

(12) United States Patent
Li et al.

(10) Patent No.: US 11,653,745 B2
(45) Date of Patent: May 23, 2023

(54) COOLING AND HYDRATING CONTAINERS AND METHODS OF USE

(71) Applicant: Qore Performance, Inc., Sterling, VA (US)

(72) Inventors: Justin B. Li, Fairfax, VA (US); J. D. Willcox, Fairfax, VA (US); Doug C. Burr, Falls Church, VA (US); Pablo Bravo, San Diego, VA (US)

(73) Assignee: QORE PERFORMANCE, INC., Sterling, VA (US)

( * ) Notice: Subject to any disclaimer, the term of this patent is extended or adjusted under 35 U.S.C. 154(b) by 6 days.

(21) Appl. No.: 15/429,944

(22) Filed: Feb. 10, 2017

(65) Prior Publication Data

US 2017/0231371 A1 Aug. 17, 2017

Related U.S. Application Data

(60) Provisional application No. 62/442,194, filed on Jan. 4, 2017, provisional application No. 62/360,795, filed (Continued)

(51) Int. Cl.

*A45F 3/16* (2006.01)
*F41H 1/02* (2006.01)

(Continued)

(52) U.S. Cl.

CPC ..... *A45F 3/16* (2013.01); *A41D 1/04* (2013.01); *A41D 13/0053* (2013.01); *A41D 13/0058* (2013.01); *A45F 3/04* (2013.01); *A45F 3/06* (2013.01); *A45F 3/18* (2013.01); *A45F 3/20* (2013.01); *F41H 1/02* (2013.01); *F41H 5/04* (2013.01); *A41D 2400/46* (2013.01); *A45F 2003/166* (2013.01)

(58) Field of Classification Search

CPC .. A41D 13/0053; A41D 13/0058; A41D 1/04; A45F 3/04; A45F 3/06; F41H 1/02; F41H 5/04

See application file for complete search history.

(56) References Cited

U.S. PATENT DOCUMENTS 4,090,650 A * 5/1978 Gotta ..... A45F 3/20 215/11.1
4,526,298 A * 7/1985 Boxer ..... A45F 3/16 222/130

(Continued)

FOREIGN PATENT DOCUMENTS

GB 2480582 A * 11/2011 ..... B01D 63/02

OTHER PUBLICATIONS

International Search Report and Written Opinion from PCT Application No. PCT/US2017/017452 dated Apr. 28, 2017.

(Continued)

*Primary Examiner* — Ana M Vazquez
(74) *Attorney, Agent, or Firm* — DLA Piper LLP (US)

(57) ABSTRACT

Bladders/containers designed to hold a meaningful amount of material (in any state: solid, liquid or gas) to conductively absorb heat from the human body. In addition, the material may be consumed by the user wearing the bladder/container, thus providing a source of hydration for the user. The bladders/containers would also enhance impact and/or ballistic protection of the user.

20 Claims, 33 Drawing Sheets

Related U.S. Application Data on Jul. 11, 2016, provisional application No. 62/307,854, filed on Mar. 14, 2016, provisional application No. 62/294,651, filed on Feb. 12, 2016.

(51) Int. Cl.

| | |
|---|---|
| ***A45F 3/04*** | (2006.01) |
| ***A45F 3/20*** | (2006.01) |
| ***A45F 3/18*** | (2006.01) |
| ***A41D 1/04*** | (2006.01) |
| ***A41D 13/005*** | (2006.01) |
| ***A45F 3/06*** | (2006.01) |
| ***F41H 5/04*** | (2006.01) |

(56) References Cited

U.S. PATENT DOCUMENTS

| | | | | |
|---|---|---|---|---|
| 4,656,840 | A | 4/1987 | Loofbourrow et al. | |
| 4,928,860 | A * | 5/1990 | Knight | B65D 1/18 215/384 |
| 5,472,124 | A * | 12/1995 | Martushev | B65D 1/06 222/529 |
| D371,281 | S * | 7/1996 | Credle, Jr. | D21/500 |
| 5,597,097 | A * | 1/1997 | Morris | B65D 25/38 222/529 |
| 5,864,880 | A * | 2/1999 | Adam | A41D 1/04 2/94 |
| 7,600,656 | B2 * | 10/2009 | Karl | A45F 3/18 222/175 |
| 7,665,156 | B1 | 2/2010 | Hewitt | |
| 2004/0079517 | A1 * | 4/2004 | Bueley | A41D 13/0053 165/46 |
| 2006/0113336 | A1 * | 6/2006 | Spencer | A45F 3/20 224/148.2 |
| 2008/0277433 | A1 | 11/2008 | Karl et al. | |
| 2009/0211000 | A1 | 8/2009 | Roux | |
| 2013/0146161 | A1 | 6/2013 | Harivel et al. | |
| 2014/0318154 | A1 | 10/2014 | Kobayashi | |
| 2017/0231371 | A1 | 8/2017 | Li et al. | |

OTHER PUBLICATIONS

Examination Report cited in Application No. GB1814577.1 dated Feb. 22, 2021.

Examination Report cited in Application No. AU 2017218348 dated Sep. 23, 2021.

Examination Report cited in Application No. AU 2017218348 dated May 6, 2022.

Notice of Acceptance for Patent Application cited in Australian Application No. 2017218348 dated Sep. 13, 2022.

Canadian Search Report issued in Application No. 3,013,929 dated Feb. 23, 2023.

* cited by examiner

COOLING AND HYDRATING CONTAINERS AND METHODS OF USE

CROSS-REFERENCE TO RELATED APPLICATIONS

This application claims priority to U.S. Provisional Application No. 62/294,651, filed Feb. 12, 2016, U.S. Provisional Application No. 62/307,854 filed Mar. 14, 2016, U.S. Provisional Application No. 62/360,795 filed Jul. 11, 2016 and U.S. Provisional Application No. 62/442,194 filed Jan. 4, 2017, the entireties of which are incorporated by reference herein.

FIELD OF THE INVENTION

Embodiments disclosed herein include unique bladders and containers for providing supplemental thermal regulation to a user's body, particularly when the user is wearing body armor or other equipment/garments that are known to cause discomfort and/or dehydration to the user. The bladders and containers disclosed herein also provide a source of hydration to the user. In addition to or alternatively, at least one container disclosed herein provides improved impact and/or ballistic protection when worn between the user and body armor.

BACKGROUND

For many military and law enforcement personnel, body armor is a way of life. In fact, it is a mandatory safety tool for this and other dangerous professions. While body armor provides life-saving protection against incoming projectiles, it has two major shortcomings: weight and heat. By nature, body armor traps a tremendous amount of heat generated by the wearer (also referred to herein as a "user"). In the process, it accelerates fatigue and discomfort while decreasing the mobility and endurance of the wearer.

To date, there has been no way for a user of body armor to be effectively cooled-down while also maintaining the user's mobility. Thus far, solutions have focused on phase change materials placed into cooling vests, which do not have meaningful endurance or longevity, are heavy, expensive and provide no utility to the user once they have reached their latent heat saturation point.

Simultaneously, the heat retained by the insulating properties of the armor itself increases the user's sweat rate, rate of dehydration and thereby increases the user's water consumption rate. Warfighters, for example, use three common methods of carrying water: (1) a backpack or body armor mounted water bladder with a remote hose for drinking the water (such as those sold e.g., by Camelbak Products, LLC.); (2) a single-use bottle of water (e.g., a typical bottle of water); and (3) reusable water bottles (such as e.g., those sold by Nalgene). All of these methods have significant shortcomings. For example, the hydration bladders easily accumulate mold and bacteria while also infusing the water supply with a "plastic" taste, which many users find undesirable. Reusable water bottles are bulky when empty and force the user to carry around an empty bottle well after the contents have been consumed. The single use water bottle delivers high quality taste enjoyed by users and gives them confidence that the water is safe because it is sealed. However, it only has one function: water delivery to the end user.

Accordingly, there is a general need for a multi-utility bladder/container that can provide both cooling and hydration to a user in an inexpensive manner, while also maintaining the mobility and endurance of the user. Ideally, this container would also enhance impact and/or ballistic protection of the user.

It is known that upon impact with a bullet body armor may experience a condition known as backface deformation. That is, the effect of a non-penetrating projectile on the rear face of a strike plate. Currently, in the United States, the National Institute of Justice sets standards for the maximum allowable deformation armor can allow while still passing ballistic tests (currently set at 44 mm). However, even with armor that meets this standard for deformation, users frequently experience significant bodily harm in the course of being shot or impacted by a projectile while wearing body armor. Injuries can often include broken bones, shock trauma and internal bleeding. Accordingly, there is a need and desire to improve impact and/or provide additional ballistic protection to body armor users.

SUMMARY

In one embodiment, a container to be worn by a user is disclosed. The container comprises a hollow body having a first port. The body is adapted to receive a substance via the first port and contain the substance for providing thermal regulation to the user's body when the container is adjacent the user's body and or providing impact protection when the container is adjacent the user's body.

In another embodiment, an apparatus to be worn by a user is provided. The apparatus comprises a container body being adapted to receive and contain a substance for providing thermal regulation to the user's body when the container body is in contact with the user's body or clothing and or providing impact protection when the container body is in contact with the user's body or clothing. The apparatus further comprises a first mechanism for holding the container body.

In other embodiments, the hollow body or container body comprises a port adapted to output the substance. A hose may be connected to the port to dispense the substance and or allow the user to drink it.

In other embodiments, the hollow body or container body comprises attachment points for receiving a mechanism for securing the body to the user's body or clothing.

In other embodiments, the hollow body or container body comprises one or more armored planes.

DETAILED DESCRIPTION

In response to the aforementioned challenges and the shortcomings of today's cooling or hydration alternatives, Qore Performance has developed multi-utility bladders and containers that provide supplemental cooling to a user's body, particularly when the user is wearing body armor or other equipment or garments that are known to cause discomfort and/or dehydration to the user, as well as a source of hydration for the user.

The disclosed embodiments may be used as a single-use or reusable bladder/container that are designed to hold a meaningful amount of material (in any state: solid, liquid or gas) to conductively absorb heat from the human body (most likely the torso). In addition, the material may be consumed by the user, thus providing a source of hydration for the user. In one embodiment, the material is water (or frozen water), but it should be appreciated that the bladder/container can be filled with any material desired by the end user, including a fluid with electrolytes.

Moreover, and as discussed below, the bladder/container may include, but is not limited to, a bite valve, sensor-equipped bite valve, screw top opening, cap opening, single use tear-off opening or other such opening whereby the user can extract the liquid contained in the bladder/container without spilling or releasing any undesired liquid contents from the bladder/container.

Figure 1A:
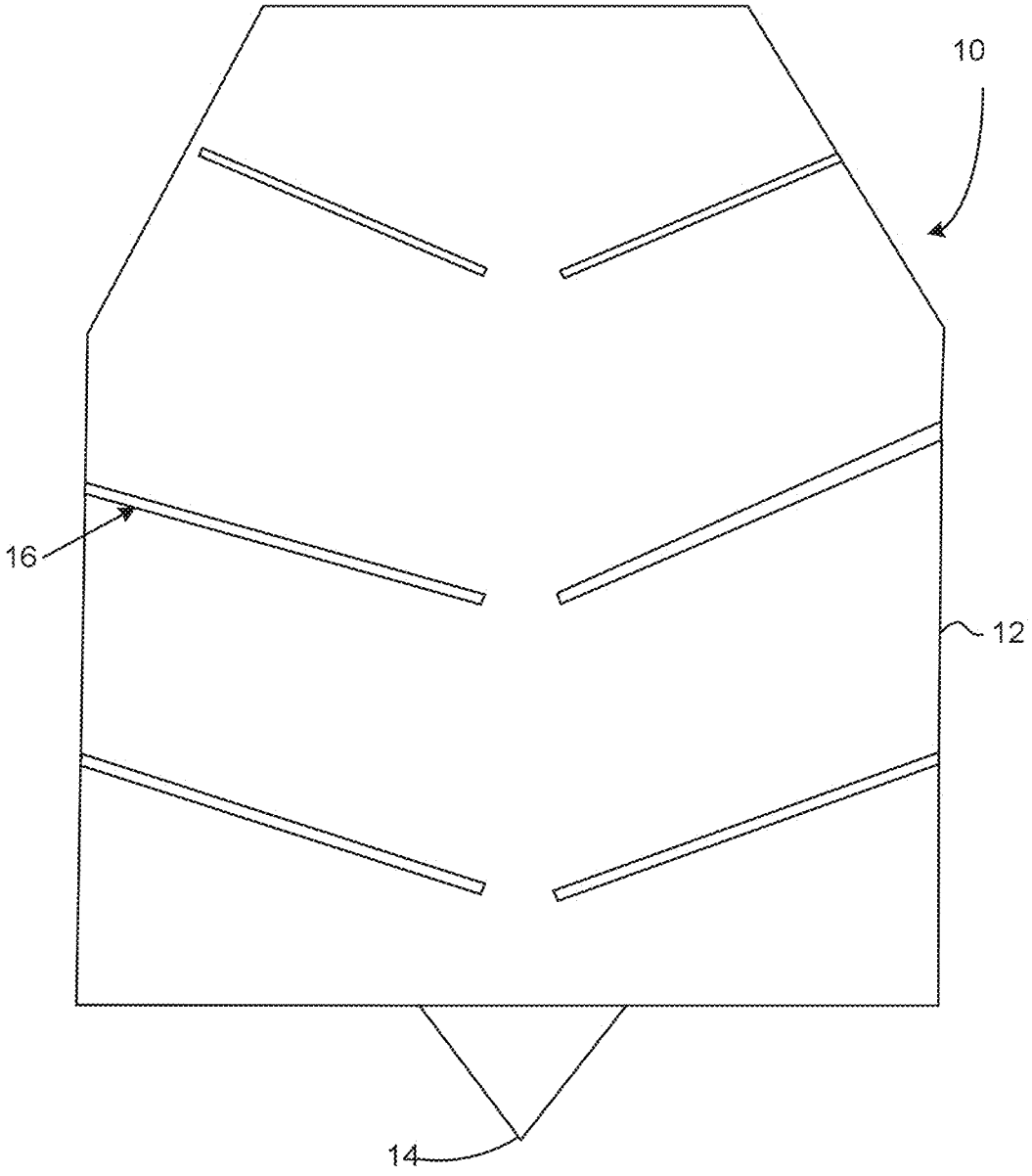
FIGS. 1A-1C illustrate various example configurations of uniquely configured containers constructed in accordance with a first embodiment disclosed herein.
Figure 1B:
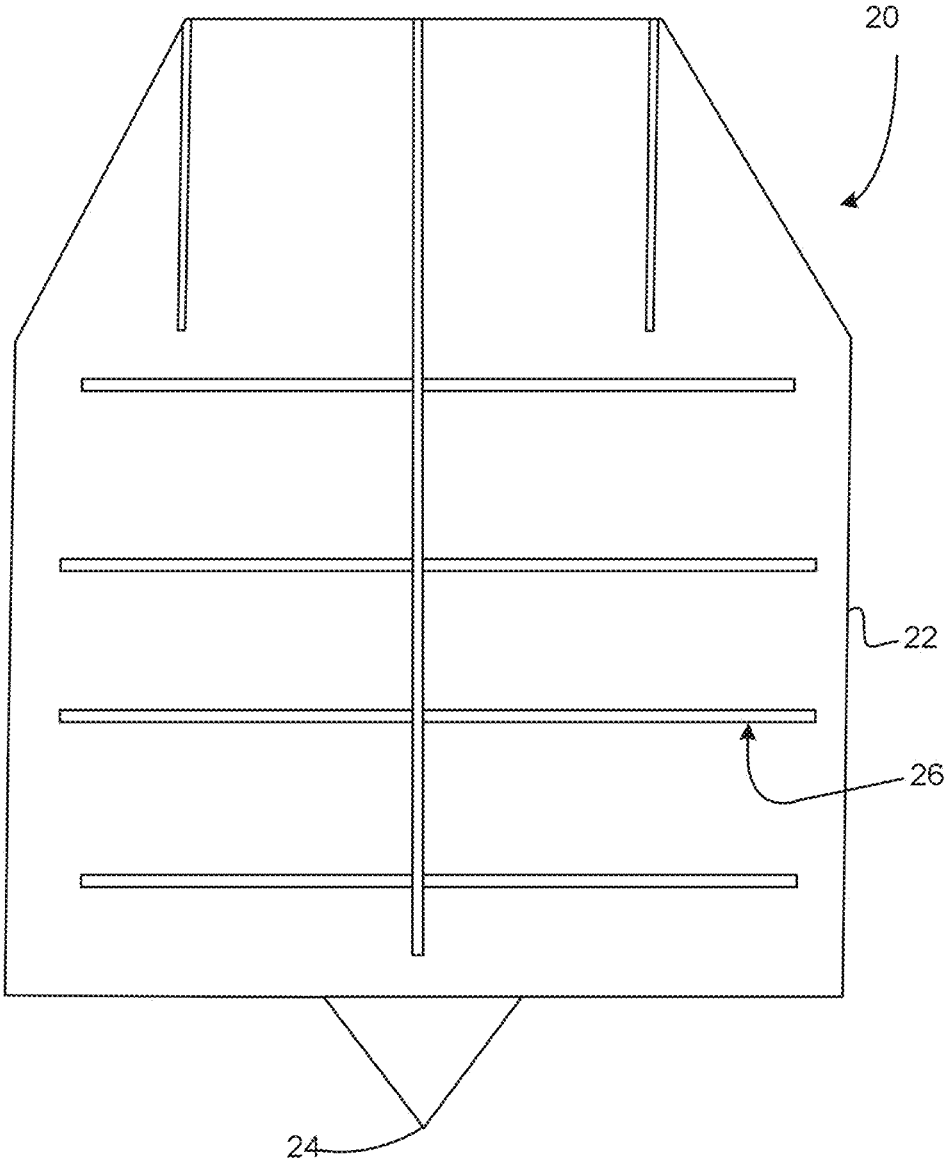
Figure 1C:
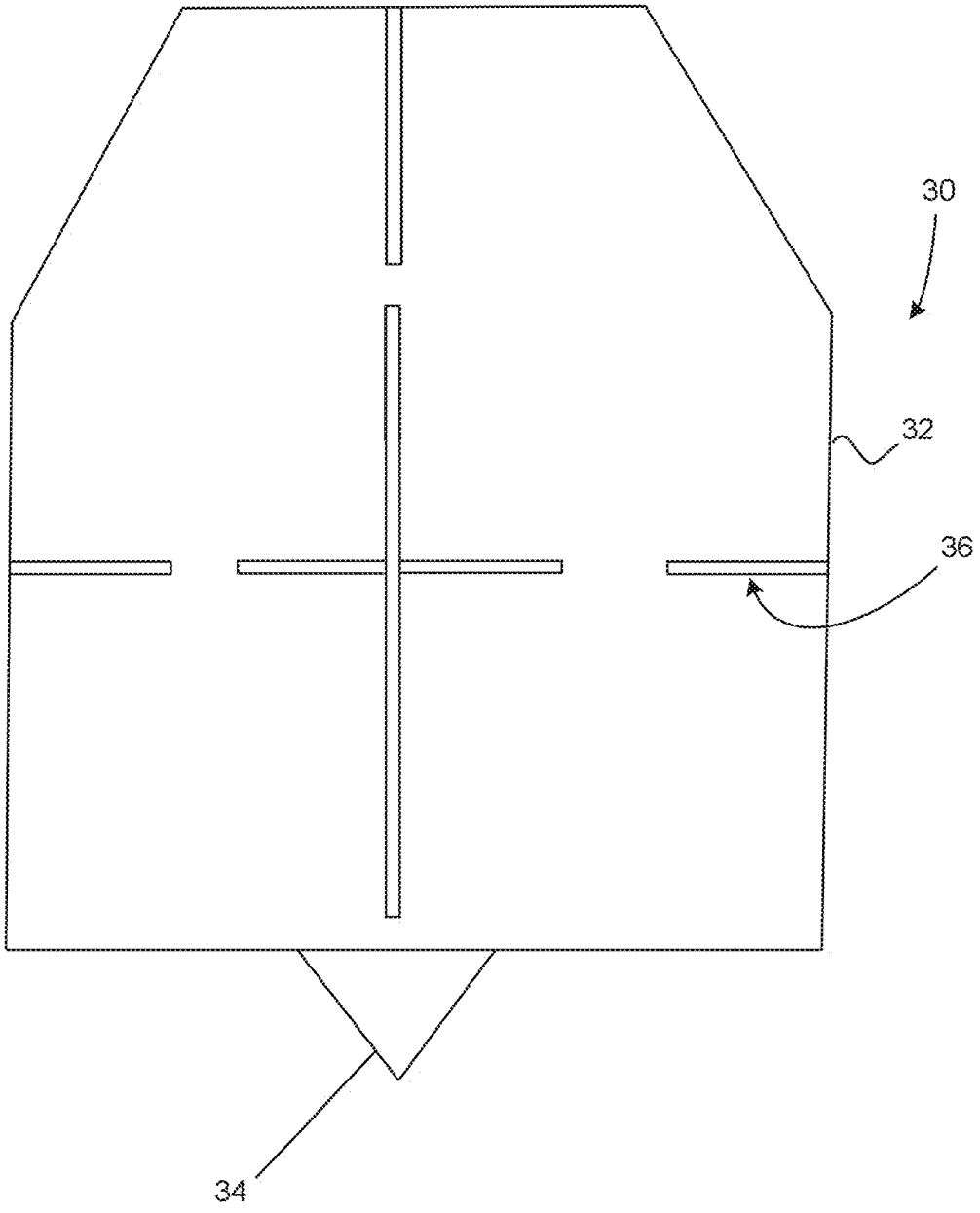

FIGS. 1A-1C illustrate various example configurations of uniquely configured containers 10, 20 30 constructed in accordance with a first embodiment disclosed herein. Each configuration comprises a liquid container shaped to match the profile silhouette of modern body armor. The unique shape of the disclosed containers comprises a trapezoidal silhouette profile often used with modern armor plates, which is a novel design over prior art water bladders.

Moreover, as shown in FIGS. 1A-1C, each configuration has another non-obvious advancement over conventional bladders in that each disclosed container has partitioned chambers within the container. The partitions are designed to prevent the accumulation of liquid in any portion of the container. Preventing accumulation of liquid in the container promotes even distribution of the liquid in the vertical (head to toe) and horizontal (between the armor and the user) planes.

In FIG. 1A, the container 10 comprises a hollow body 12 having a drain port 14 and partitions 16. In the illustrated embodiment, the partitions 16 form a chevron shape. In FIG. 1B, the container 20 comprises a hollow body 22 having a drain port 24 and partitions 26. In the illustrated embodiment, the partitions 26 are in a tree-like shape. In FIG. 1C, the container 30 comprises a hollow body 32 having a drain port 34 and partitions 36. In the illustrated embodiment, the partitions 36 are in a grid shape. It should be appreciated that other shapes and configurations of the partitions are possible and that the disclosed principles are not to be limited to the configurations shown in FIGS. 1A-1C. As shown in FIGS. 1A-1C, each container has a tapered edge at the bottom portion of its body that serves as the exit point for liquid contained in the container. An extraction/suction hose (shown as hose 206 in FIG. 8A) will be attached to the containers 10, 20, 30 at that point, providing the user with the ability to consume the contents within the containers. The user then places the container in between his/her shirt/base layer and his/her body armor. The container is held in place for example by a strap system (described below in more details), carrier such as a plate carrier or backpack, or the tension of worn body armor itself.

Figure 2:
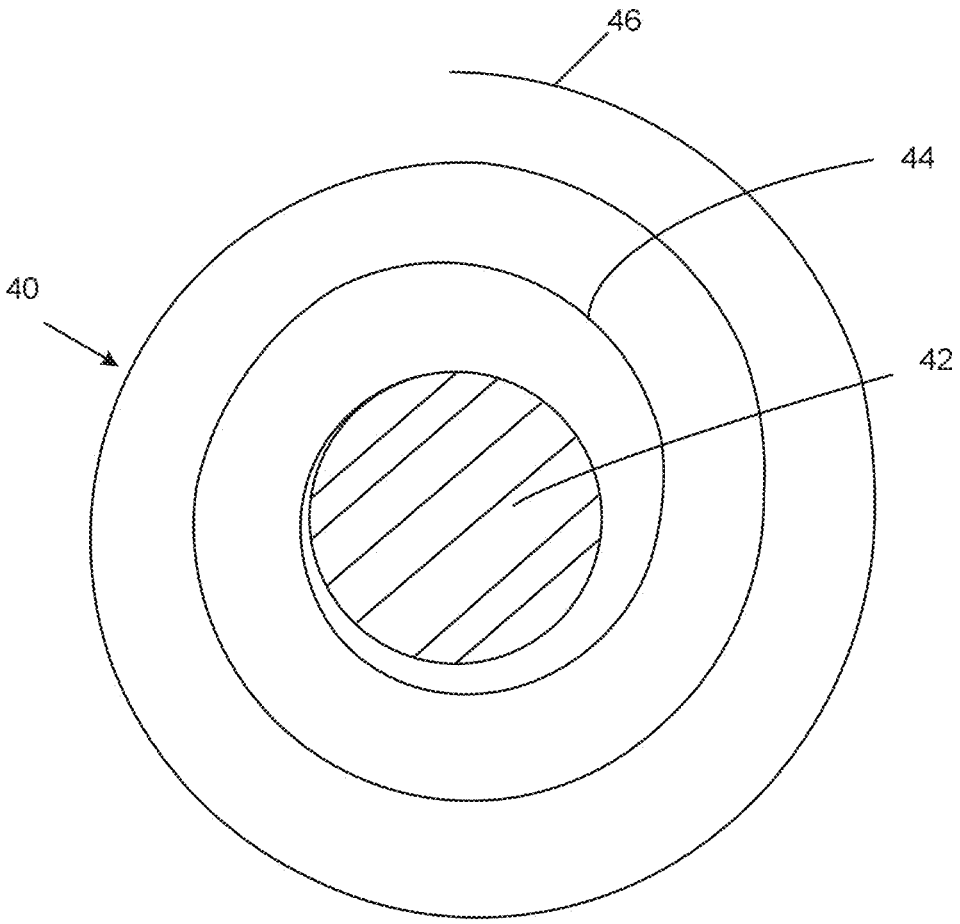
FIG. 2 is an example of a coil flow liquid container constructed in accordance with a second embodiment disclosed herein.

FIG. 2 is an example of a container 40 constructed in accordance with a second embodiment disclosed herein. The disclosed container 40 includes a hollow coil 44 connected to a flat spherical bladder 42 at the center of the coil 44. Accordingly, this embodiment maybe referred to as a coil flow liquid container (CFLC). The flat spherical bladder 42 resembles a three-dimensional pancake. The bladder 42 and the coil 44 may have identical thickness profiles. The bladder 42 is designed to increase capacity and create the greatest volume of continuous solid mass to slow the melting rate of the heat-absorbing material therein. In one embodiment, the filled (e.g., with water) CFLC 40 is placed in a freezer to create a solid (i.e., ice) within the coil 44 and/or bladder 42. The user then places the frozen CFLC 40 in between his/her shirt/base layer and his/her body armor. The tension of worn body armor will then hold the CFLC 40 in place. The container 40 may also include a bite valve 46 at the end of the coil 44 that is not attached to the bladder 42.

Figure 3A:
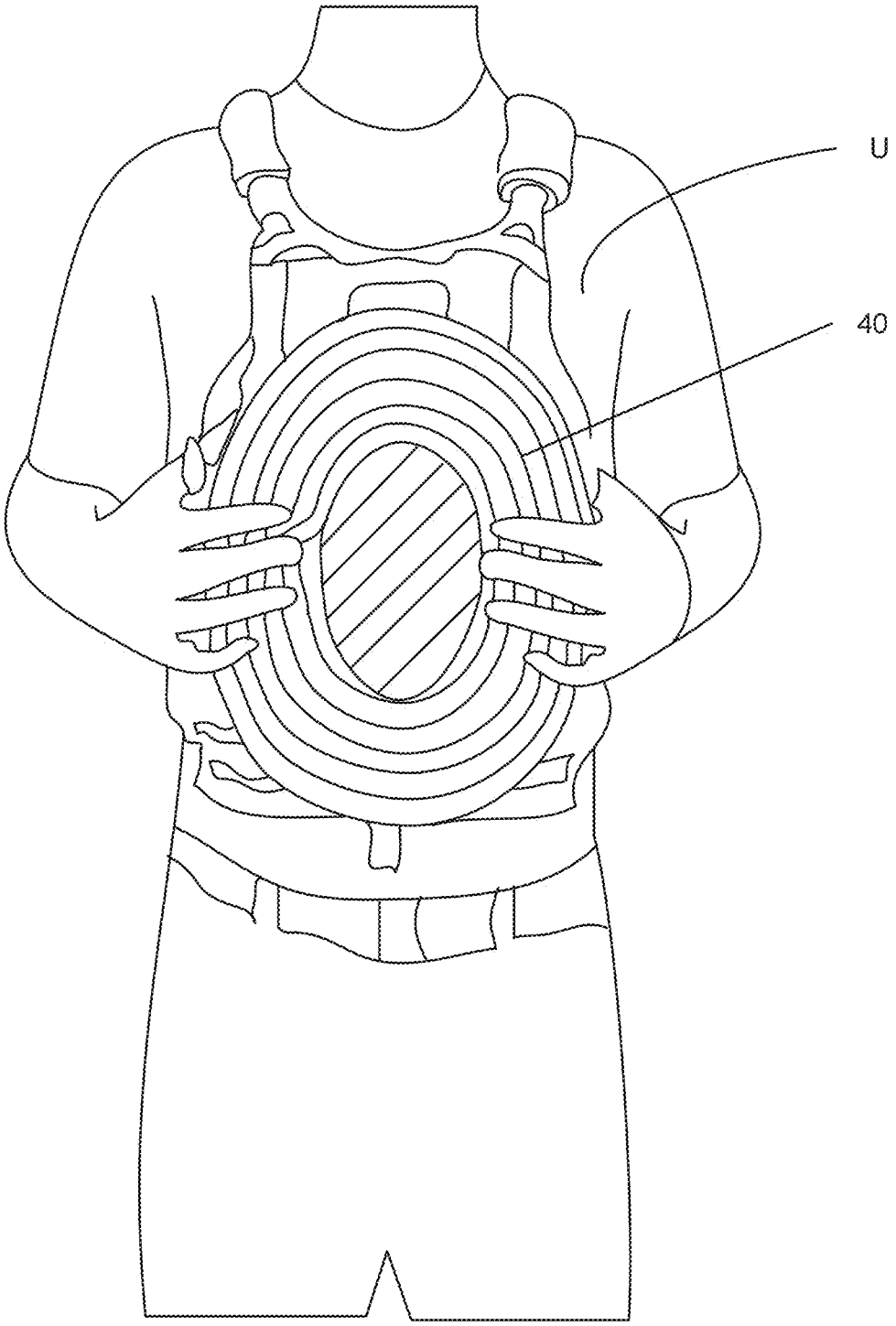
FIGS. 3A-3D illustrate an example use of the coil flow liquid container of FIG. 2.
Figure 3B:
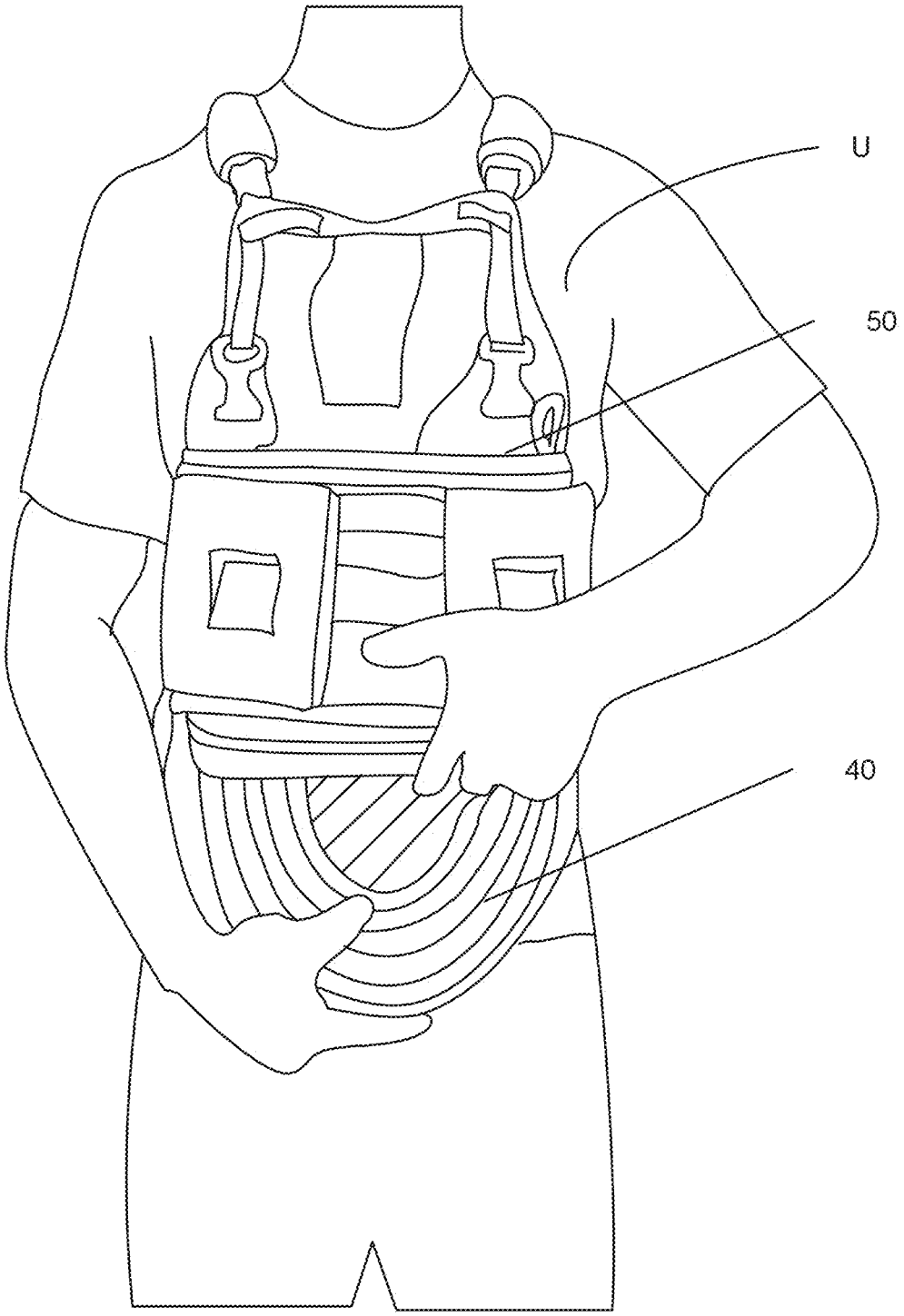
Figure 3C:
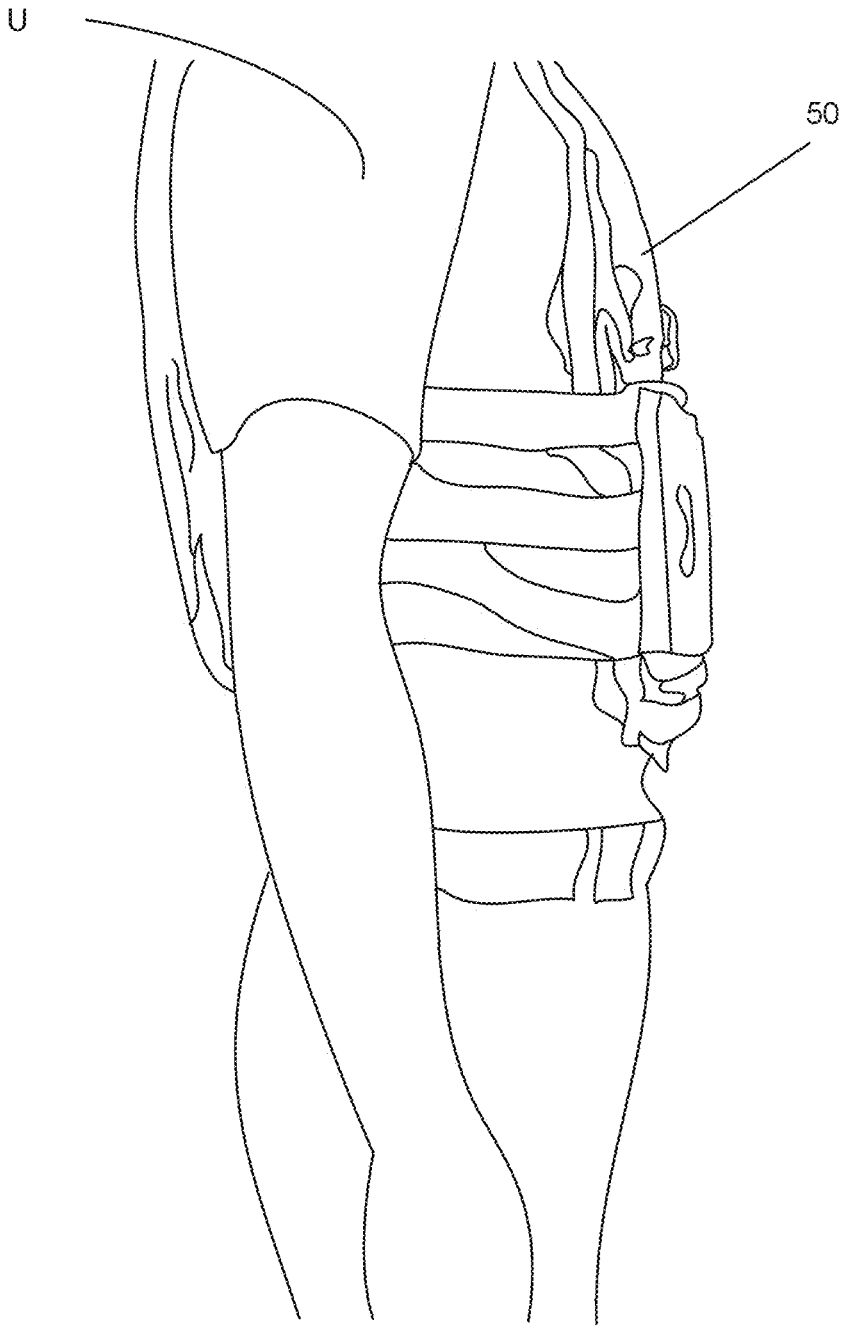
Figure 3D:
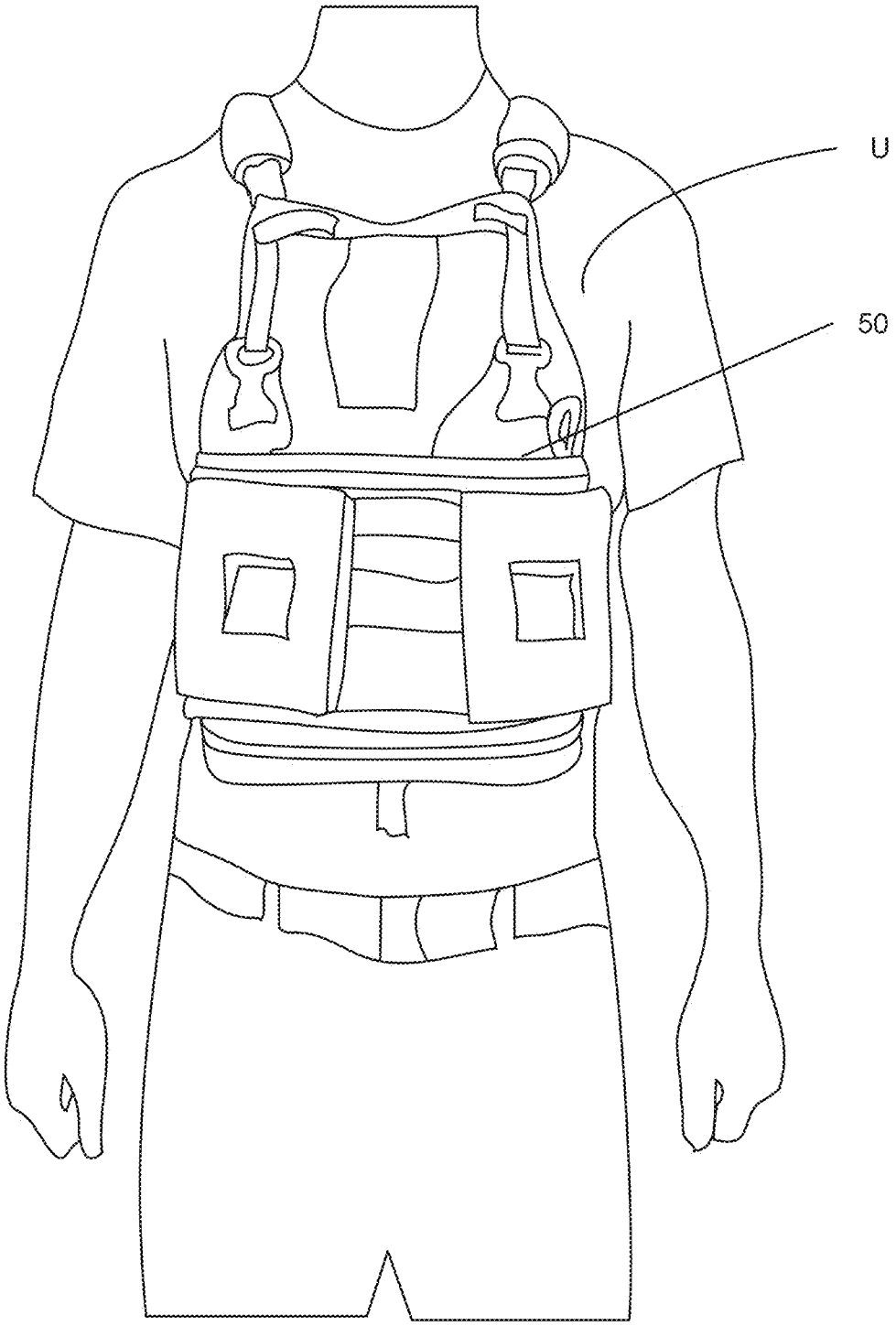

FIGS. 3A-3D illustrate use of the coil flow liquid container 40 illustrated in FIG. 2. FIG. 3A illustrates a front profile of the FIG. 2 container 40 before it is placed between the user U and his/her body armor 50 (FIG. 3B). FIGS. 3C and 3D illustrate side and front profile views, respectively, of the FIG. 2 container 40 after it has been placed between the user U and his/her body armor 50.

Figure 4:
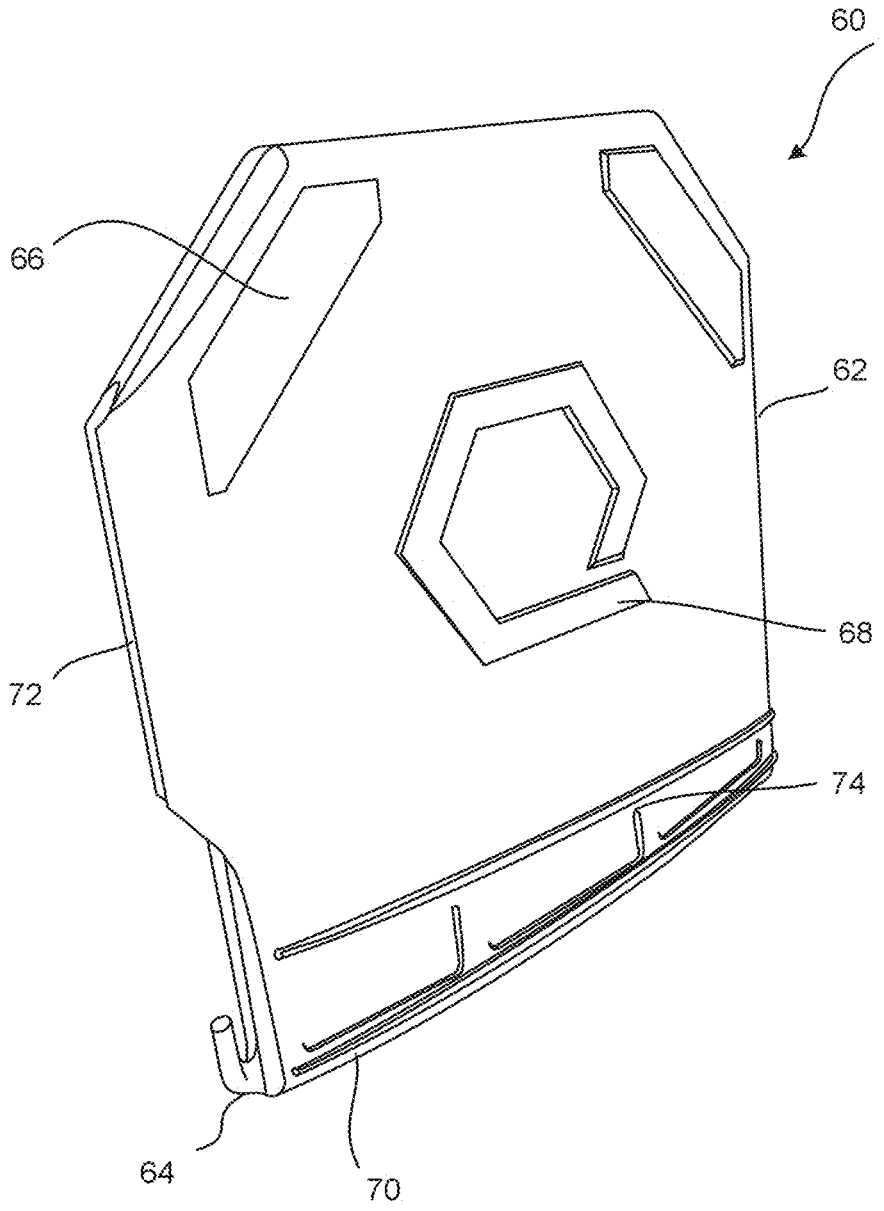
FIG. 4 illustrates an example of a container constructed in accordance with a third embodiment disclosed herein.

FIG. 4 illustrates an example of a container 60 constructed in accordance with a third embodiment disclosed herein. The container 60 includes a hollow body 62 and multiple features designed to provide additional functionality or comfort to the wearer of the container. For example, the illustrated container 60 includes grip handle geometry 66, which are positive or negative reliefs in the body 62 of the container 60 that are designed to improve a user's ability to grip or hold the container 60. The illustrated embodiment may also include stackable male/female relief geometry 68, which are positive or negative reliefs in the body 62 of the container 60 designed to create a locking/mating mechanism with other parts to facilitate stacking or linked linear storage of multiple containers. The illustrated embodiment may also include an asymmetrical low point drain geometry 70, which is designed to create an asymmetric low point drain for a stronger and more efficient fluid extraction point out of the container 60. The illustrated embodiment may also include a C-channel hose retainer 72 on one side of the container body 62, which is designed to retain the hose discussed above (and shown in FIG. 8A) on the container 60 in a secure and safe manner. The illustrated embodiment may also include flexible lateral inserts 74 to facilitate body contour matching, which is discussed in more detail below. Moreover, the illustrated embodiment may also include a side port drain nozzle 64, which is designed to prevent interference with belts, body parts and/or clothing associated with frontal or bottom mounted drains, extraction ports or nozzles. It should be appreciated that the third embodiment may be held in place and used as discussed above and below for the other embodiments disclosed herein. Moreover, the third embodiment may be constructed from the same materials and will provide at least the same benefits of the other embodiments disclosed herein.

Figure 5A:
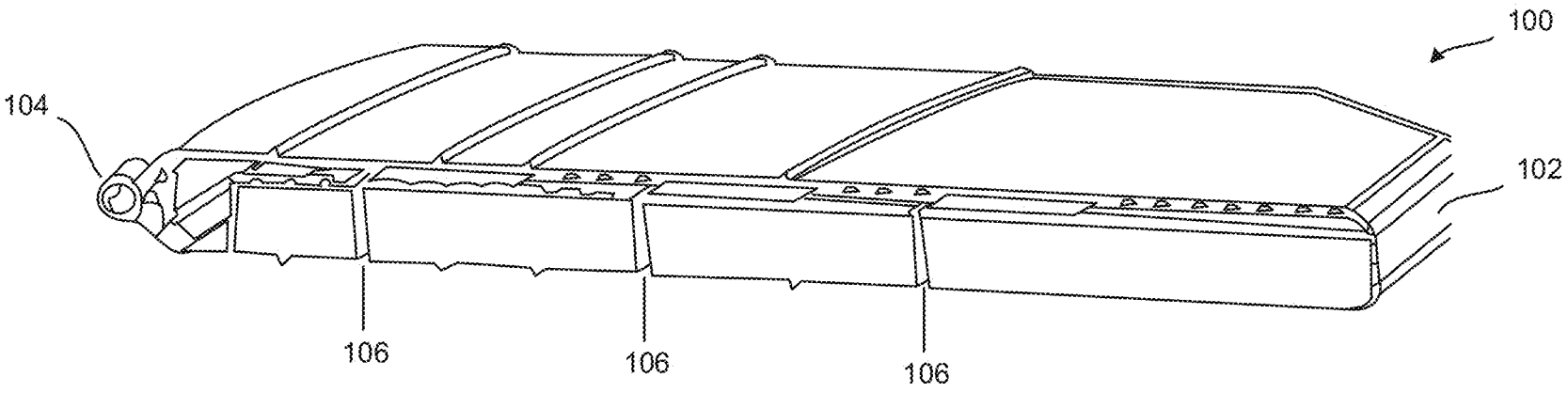
FIGS. 5A-5D illustrate example flex channels of a container constructed in accordance with an embodiment disclosed herein.
Figure 5B:
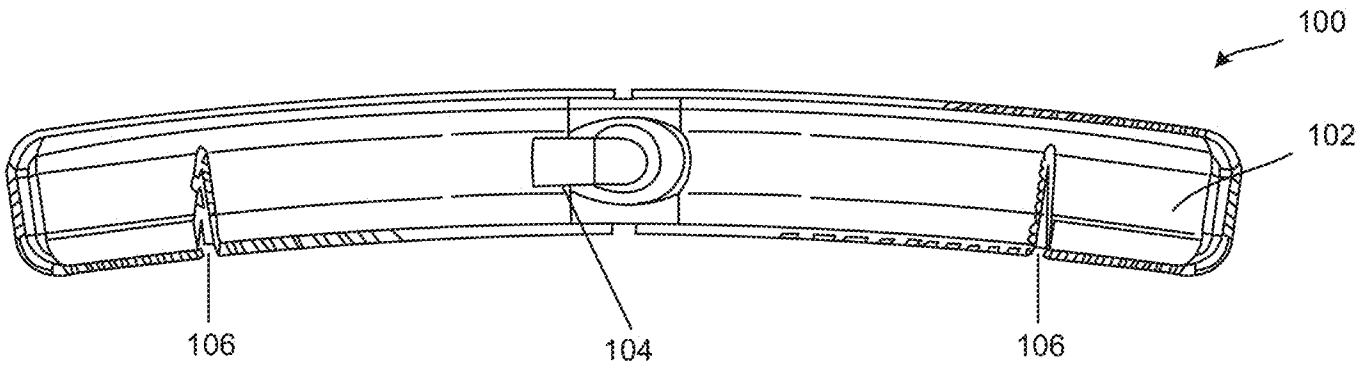
Figure 5C:
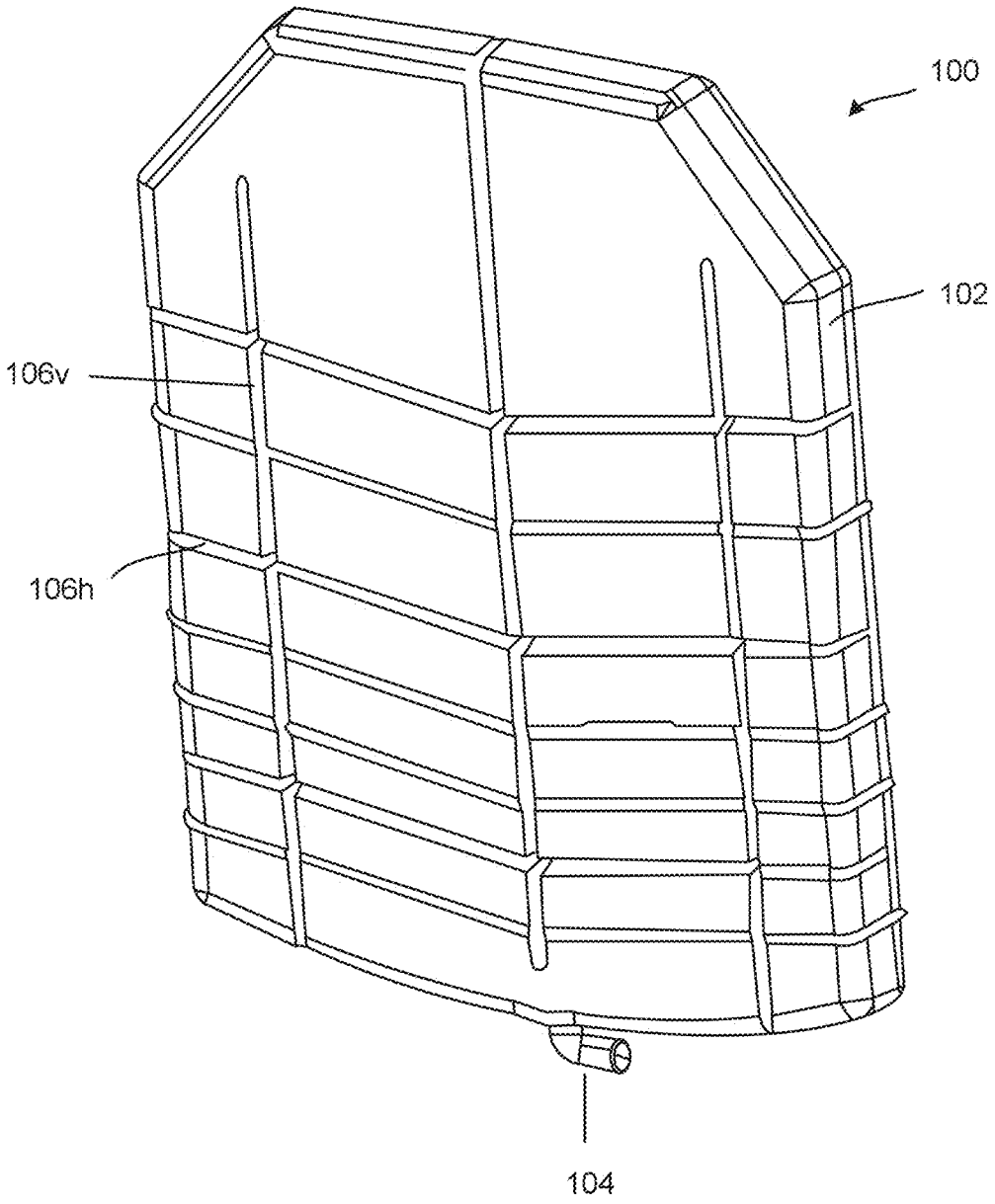
Figure 5D:
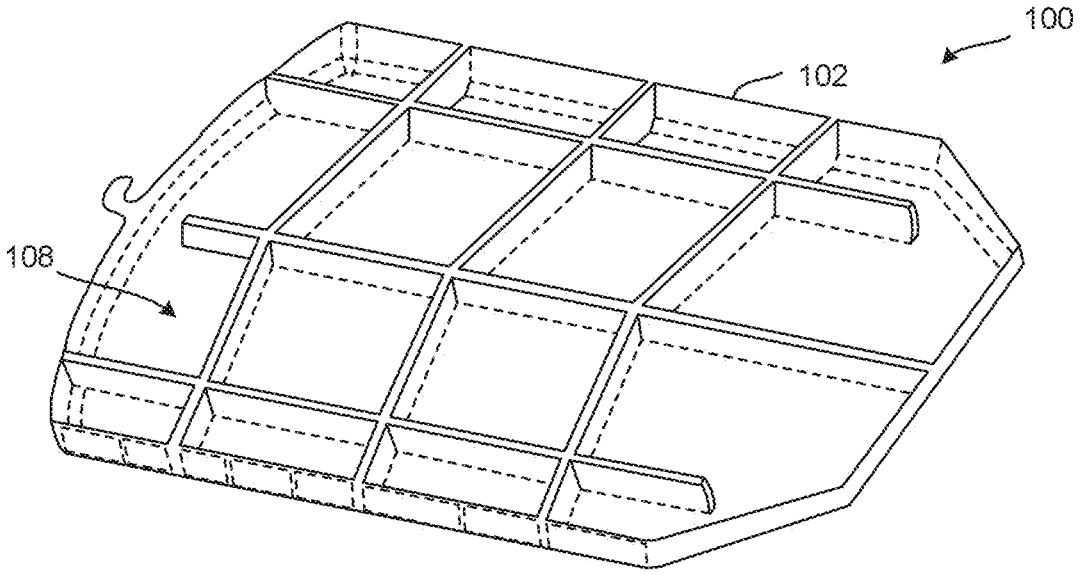

FIGS. 5A-5D illustrate a container 100 constructed in accordance with an embodiment disclosed herein. The container 100 includes a hollow body 102 with a drain port 104 and flex channels 106. The illustrated embodiment may be constructed from the same materials and will provide at least the same benefits of the other embodiments disclosed herein. The FIG. 5A embodiment illustrates the port 104 on one side of the bottom of the body 102 while the embodiment illustrated in FIGS. 5B-5D illustrate the port 104 in substantially the center of the bottom portion of the body 102. The illustrated channels 106 will facilitate bending of the container 100 at the base of the channels 106 such that the entire container 100 flexes based on the pressure placed on it by clothing, straps, body, other outside forces, etc. In the illustrated embodiment, the channels 106 run vertically 106V and horizontally 106H in such a manner that melting water inside the container 100 will naturally flow toward the lowest point to the drain 104. It should be appreciated, however, that the direction of the channels 106 are not limited to horizontal and vertical directions and that the channels therefore can be in other directions depending on the desired flexure points. In addition to the above stated purpose/function provided by the channels 106, the channels 106 will also act as partial bulkheads to facilitate even melting of the substance within the container 100.

The above embodiments have been described for the most part as being held in place by tension between the armor and the user. It should be appreciated, however, that each embodiment discussed above or below could be provided with a strap, strap system, or other securing mechanism (either attached to the bladder/container or separate from the bladder/container) that could be used to maintain the embodiments in place, should this be desired.

Figure 6:
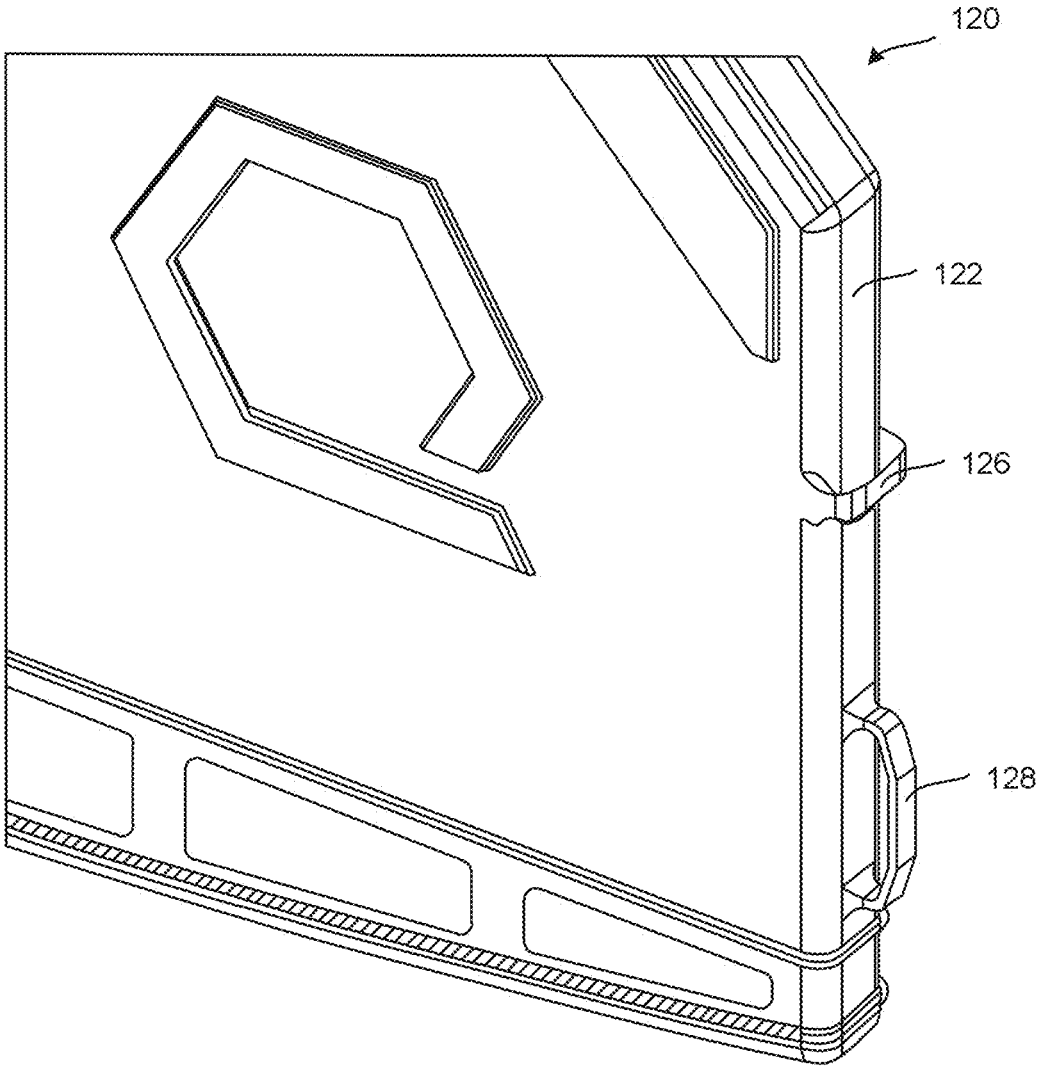
FIG. 6 illustrates example field expedient attachment points of a container constructed in accordance with an embodiment disclosed herein.

Moreover, as shown in FIG. 6, field expedient attachment points 126, 128 could be included on the body 122 of a container 120 constructed in accordance with the disclosed principles. In use, the user could attach/clip/tie accessories or use existing straps on the wearer's clothing to secure the container 120 in place using the attachment points 126, 128. Additionally, hook and loop fasteners (e.g., Velcro®) or other adhesive material could be secured to the face of the container 120 to facilitate attachment of external accessories or to enhance the stability of the container 120 when worn underneath a backpack or plate carrier.

Figure 7A:
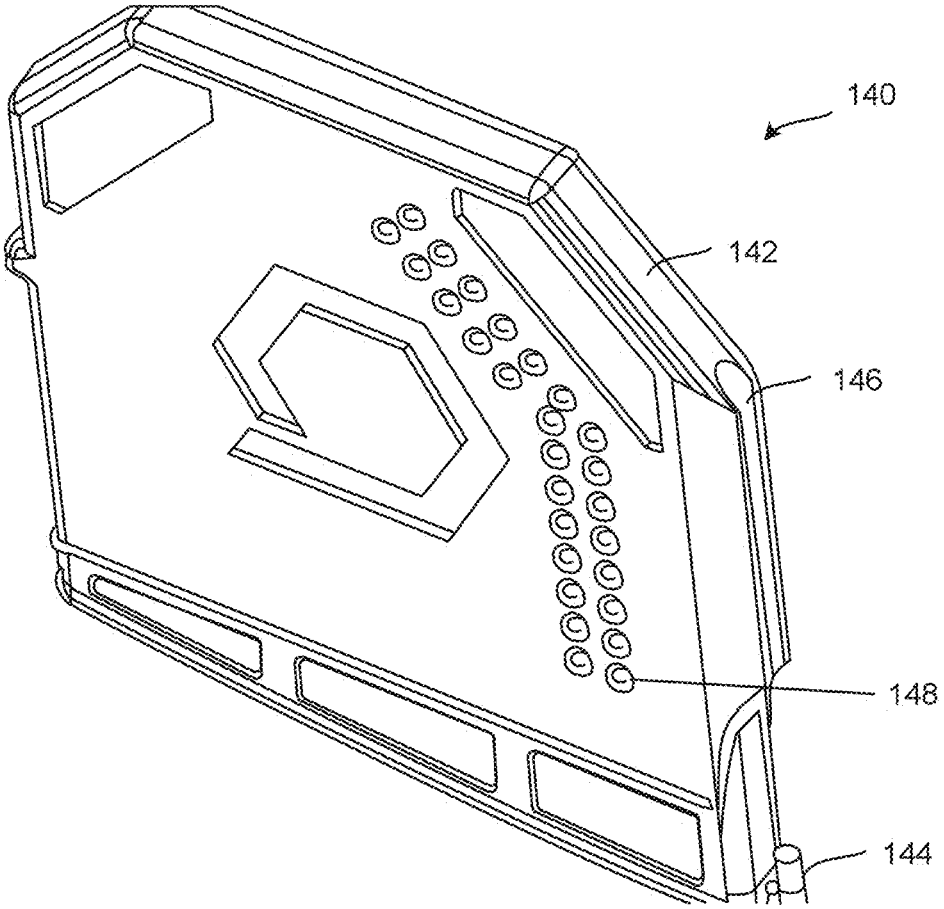
FIGS. 7A-7B illustrate example features for providing cold pressure points to a container constructed in accordance with an embodiment disclosed herein.
Figure 7B:
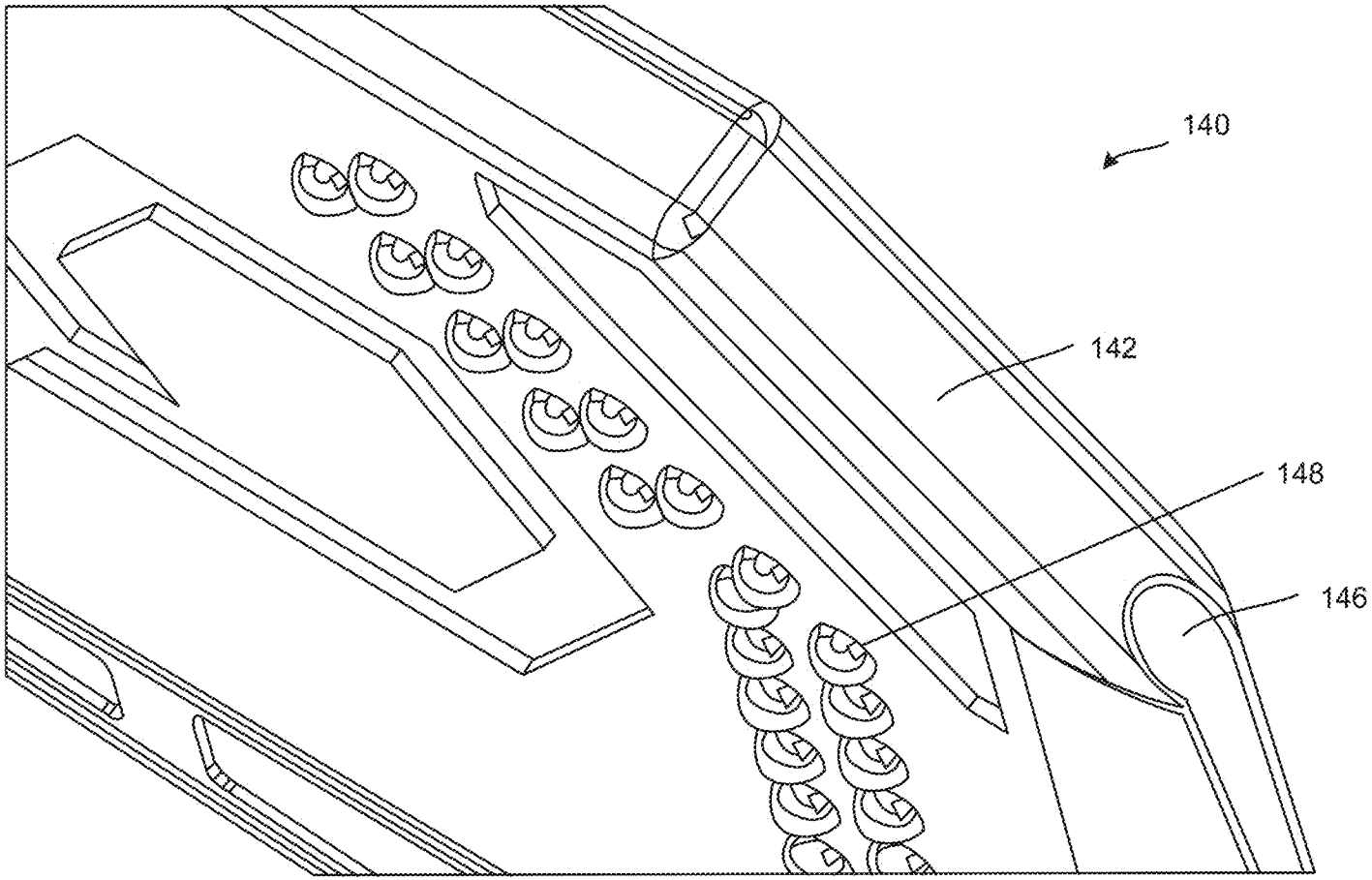

FIGS. 7A-7B illustrate example features 148 for providing cold pressure points to a container constructed in accordance with an embodiment disclosed herein. In the illustrated embodiment, a container 140, which may be any container disclosed herein, has a hollow body 142, drain 144 and hose retainer 146, but it should be appreciated that any container having a rigid body as disclosed herein may contain the features 148. The features 148 are shown as dome-like protrusions, but could take on any type of shape. The features 148 can be formed as part of or attached to the container's body 142 at portions of the container 140 in which the skin of the wearer does not completely contact the container 140 efficiently using just a flat surface. As can be appreciated, the features 148 in the container geometry purposely protrude into/onto the clothing/skin of the user when worn to create "cold pressure points." The pressure points would desirably create a sense of increased temperature sensitivity and a perceived additional cooling benefit for the user when the container is worn. In a desired embodiment, the features 148 are made from the same material as the material used for body 142.

As described above, each embodiment provides a hose or coil that the user can use to consume the contents of the bladder/container. A bite valve (e.g., valve 216 in FIG. 8A) can be attached to the hose/coil. Moreover, the bite valve could be equipped with a sensor package to analyze saliva and provide the user with information related to the consumption of the bladder/container's contents. This data may be transmitted wirelessly to at least three different devices. The first device would be a display at the command and control elements in charge of monitoring the user's (e.g. a warfighter) mission. The data could also be transmitted to the unit medic and displayed on a PDA carried by the medic. The PDA would alert the medic, based on the saliva data, if any members of the unit are in danger of dehydration, heat exhaustion or other medical conditions that can be monitored using saliva data. In addition to, or alternatively, the bite valve can be removed if desired by the end user to place on another or disposable bladder/container when contents have been exhausted.

In operation of any of the embodiments disclosed herein, for warm environments it is desired that the contents within the bladder/container be initially in a solid state (e.g., frozen). As the contents of the bladder/container change state from solid to liquid, heat is conductively absorbed from e.g., the torso or back of the user. This will cool the user, boost his/her hydration and endurance simultaneously. The user can then consume the liquid at a rate determined by the user and/or determined by the data from the bite valve sensor.

In one embodiment, the sidewalls of the bladder/container are made from a collapsible material that permits extraction of the liquid by the user. The bladder/container may collapse onto itself to permit liquid extraction because the bladder/container is air tight—preventing air from displacing water in the bladder/container.

In other embodiments, a multi-durometer construction of the containers may be used to provide additional benefits. For example, a lower durometer would be used in areas requiring more flexing while a higher durometer would be used in areas requiring more structure. This would create a final assembly that would better adhere/match the contours of the user when worn by the user. In another example, a more rigid outer shell would provide more impact protection while a collapsible inner shell would promote efficient liquid consumption or hygiene.

The disclosed embodiments may provide an additional advantage that is not obtainable by prior art alternatives. Specifically, the introduction of a large volume of liquid between the user's body and e.g., the body plate carrier will functionally serve as a cushion against impact trauma. This is discussed in more detail below with respect to FIGS. 13A and 13B.

In one embodiment, micro-perforations are added to the outer perimeter of the coil (FIG. 2), which will provide a "path of least resistance" for the water to escape in the event the tube is compressed by the force of an incoming round impacting the plate. The perforations are designed to maintain full structural integrity under normal operating conditions, but fail upon the introduction of ballistic force levels. In another embodiment based on the embodiments of FIGS. 1A-1C, the micro-perforations are added to the outer perimeter of the containers 10, 20, 30, which will provide a "path of least resistance" for the water to escape in the event the container body is compressed by the force of an incoming round impacting the plate. The perforations are designed to maintain full structural integrity under normal operating conditions, but fail upon the introduction of ballistic force levels.

Figure 8A:
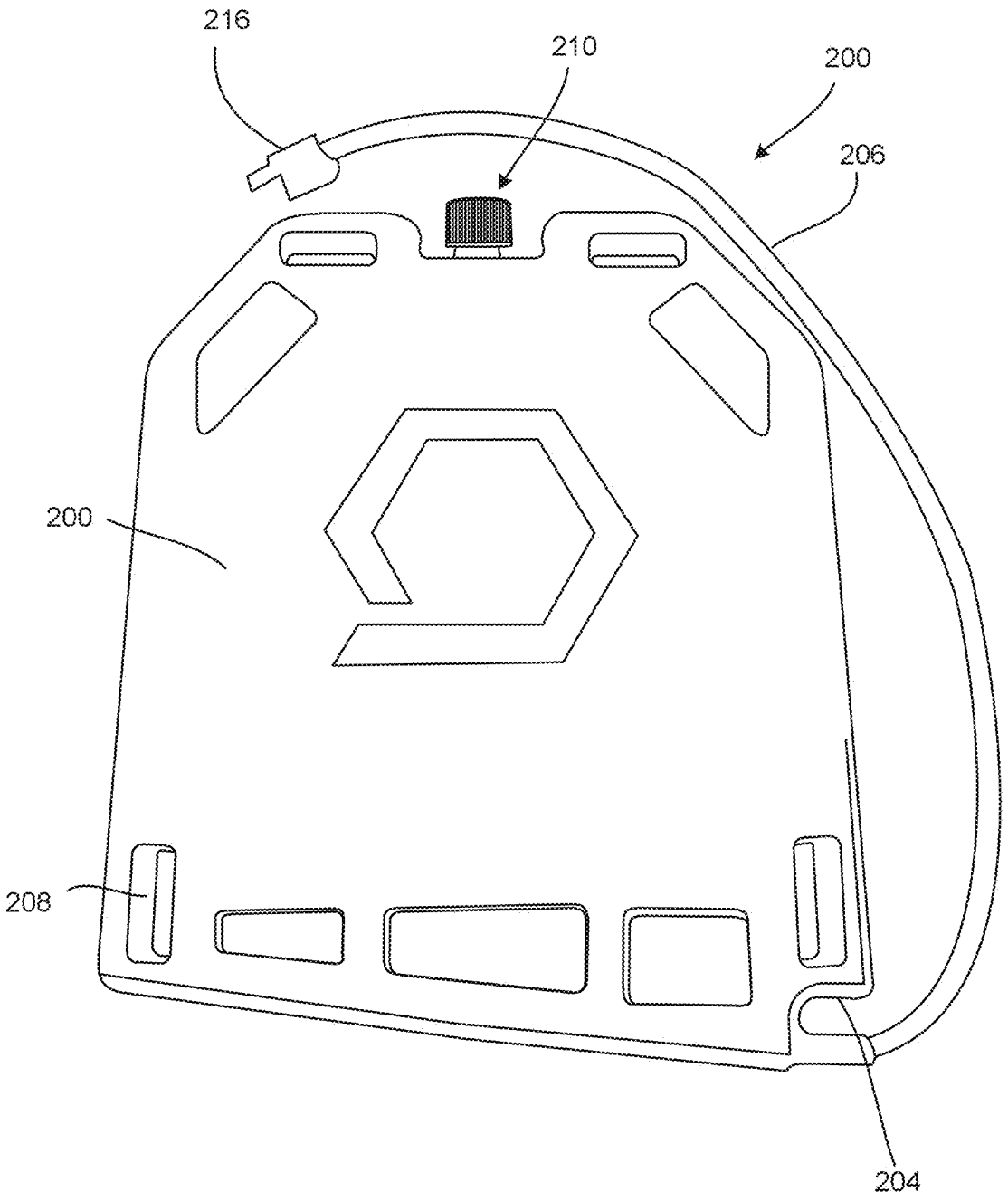
FIGS. 8A-8B illustrate an example container constructed in accordance with another embodiment disclosed herein.
Figure 8B:
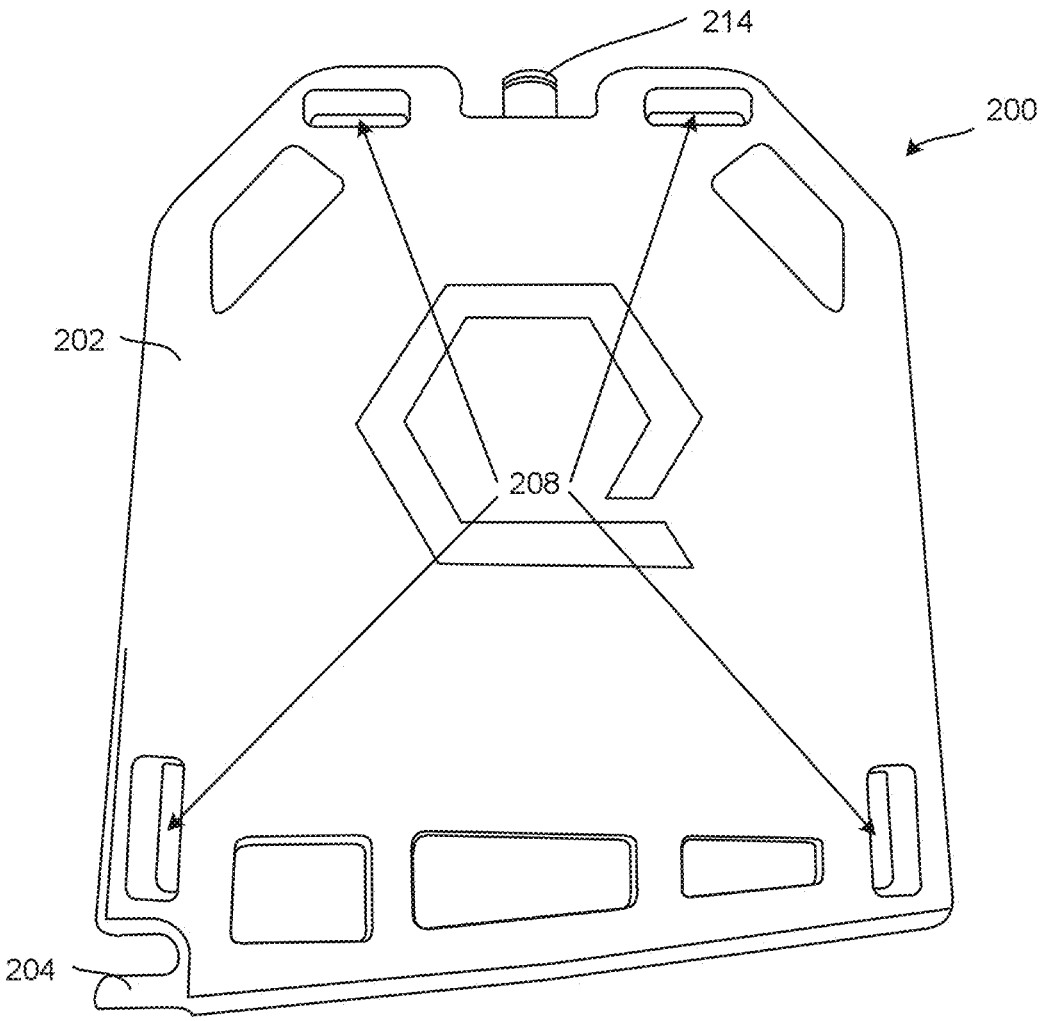

FIGS. 8A-8B illustrate an example container 200 constructed in accordance with another embodiment disclosed herein. The container 200 includes a hollow body 202 with a drain 204. The illustrated embodiment may be constructed from the same materials and will provide at least the same benefits of the other embodiments disclosed herein. A fill port 214 is formed within the body 202 and may be covered with a cap 210. A hose 206 is connected to the drain 204 and has a bite valve 216 formed at the end opposite the end attached to the drain 204. In the illustrated embodiment, channels/partitions are not formed into the container 200 or its body 202. It should be appreciated that that the internal dividers and/or baffles are not required to create the cooling, water carriage and impact protection properties of the container disclosed herein. The illustrated container 200 experiences increased flow rate (i.e., flow rate expansion) because the exit nozzle/drain 204 and attached hose 206 diameter has been enlarged compared to other hydration devices known in the art. This facilitates higher fluid flow rates and thus expedites fluid transfer to the user. This increased flow rate is possible due to the increased pressure caused by the asymmetric low point drain 204. This is a novelty unique to the container 200 illustrated in FIGS. 8A-8B.

The illustrated embodiment also includes mounting loops 208 formed in the container body 202. In this embodiment, the mounting loops 208 are integrally molded into the container body 202 and mounted inboard from the edges of the container 200 to provide additional strength, convenient attachment ports, and manufacturing efficiency. This embodiment is as an alternative to the embodiment illustrated in FIG. 6, which depicted these as external attachment points 126, 128.

FIGS. 9A-9D illustrate various mounting mechanisms for a container (e.g., container 200) constructed in accordance with an embodiment disclosed herein. The illustrated mounting mechanisms are used to secure a container disclosed herein to both a user wearing body armor and a user not wearing body armor. It should be appreciated that the illustrated embodiments are merely examples and not meant as the only ways of attaching the container to the wearer's kit.

Figure 9A:
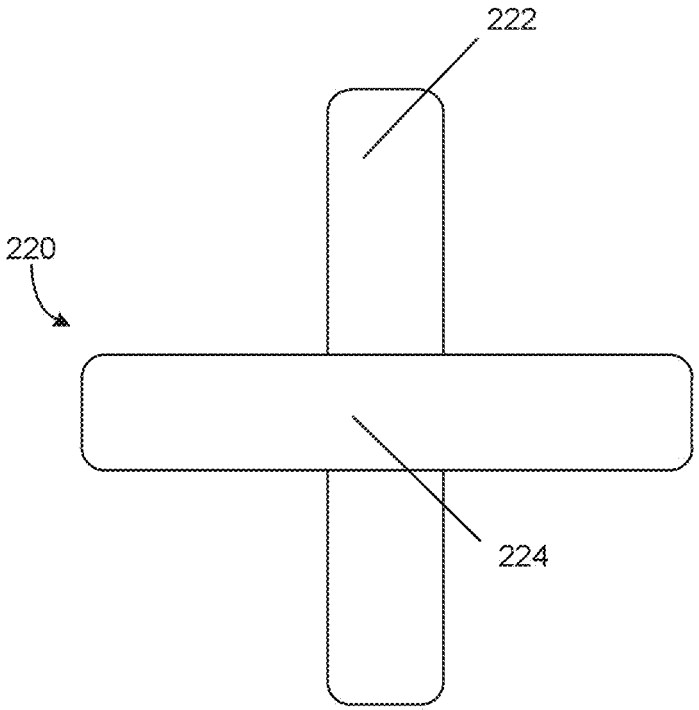
FIGS. 9A-9D illustrates various mounting mechanisms for a container constructed in accordance with an embodiment disclosed herein.
Figure 9B:
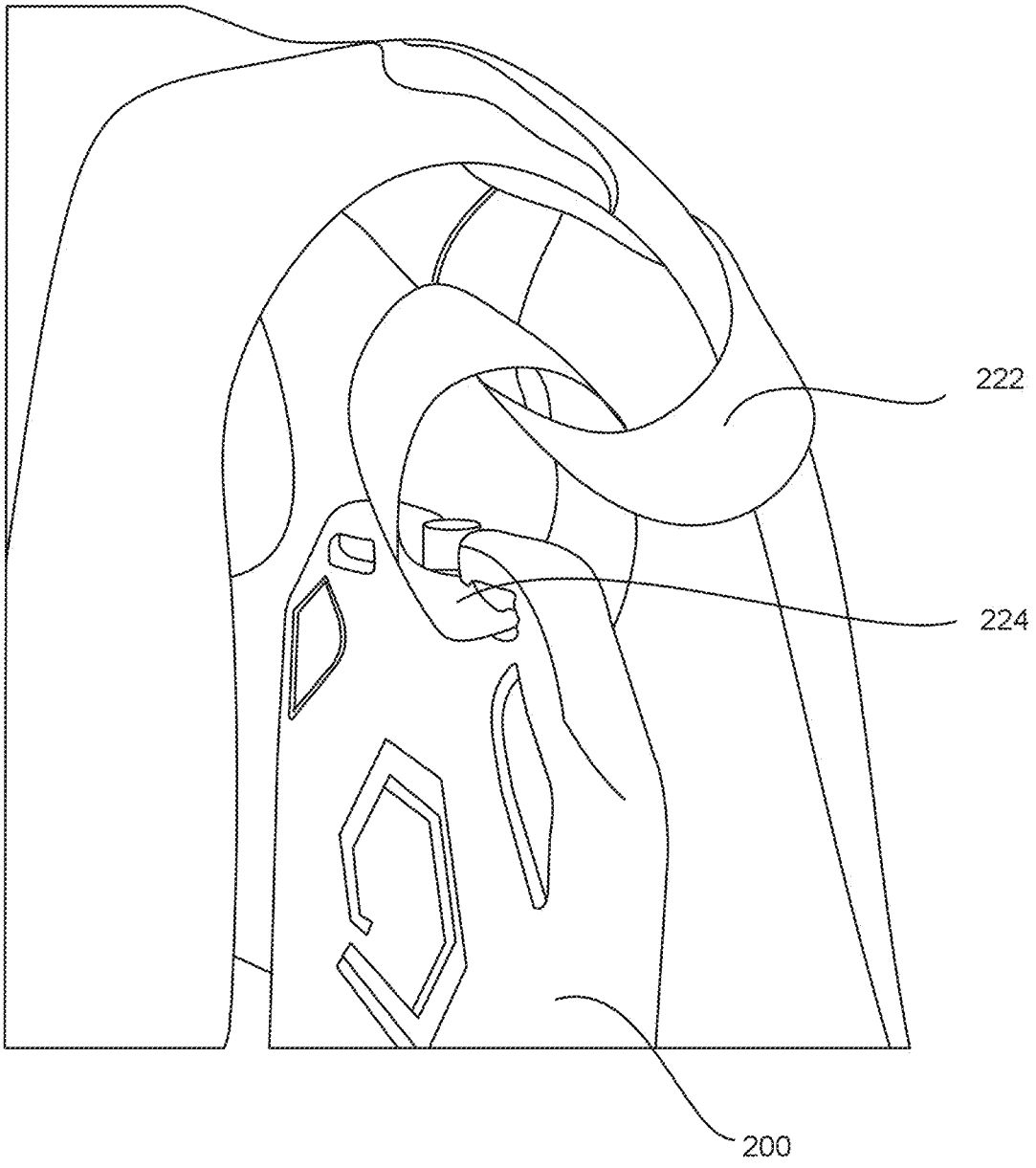

The illustrated embodiment shown in FIGS. 9A and 9B uses a cross strap system 220 comprising two straps 222, 224, which are adjustable lengths of webbing connected in a cross or "t" shaped fashion such that they allow one strap (e.g., strap 222) to be secured to the shoulder straps of pullover garments such as soft body armor (like that commonly worn by law enforcement) or safety vests (like those commonly worn by construction or industrial workers). The second adjustable length of strap (e.g., strap 224) or webbing is laced through dedicated ports (loops, hooks, etc.) on the container 200.

Each length of strap 222, 224 is adjustable to facilitate a variety of users body types, sizes and heights. The straps could be made from nylon, spandex, Velcro® or other hook and loop material, polyester, natural fibers, cotton, plastic, elastopolymer or other such material that is strong and commonly used in the same manner as rope, webbing or cord. The looping/locking attachment mechanism could be made from any number of common fastening materials, such as hook and loop, Velcro®, quick disconnects, magnets, male/female connectors, d-rings, carabiners or similar to facilitate securing of the container to exterior garments or armor. In addition, more than one strap system 220 could be used when e.g., the container has more than one mechanism for receiving straps, etc.

Figure 9C:
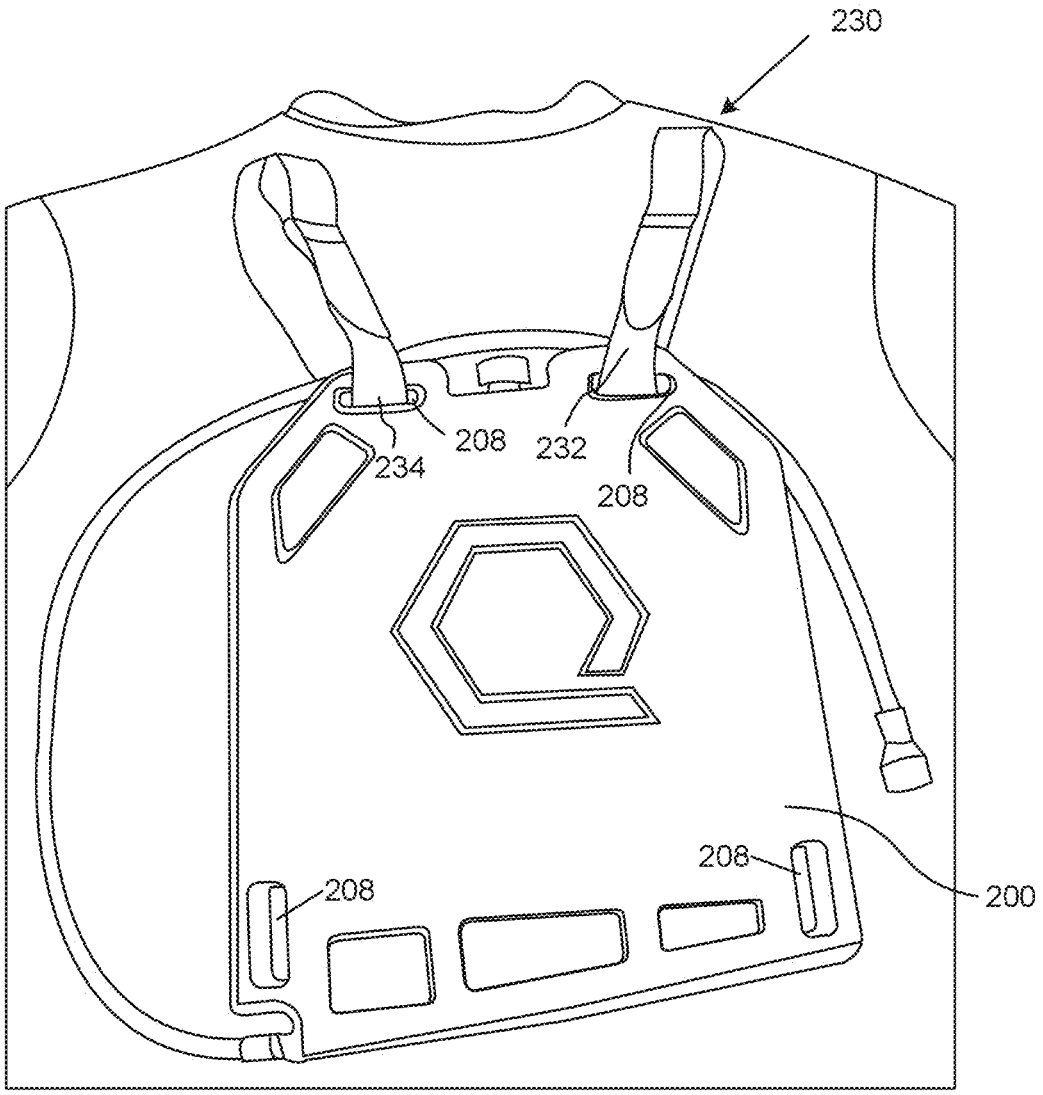
Figure 9D:
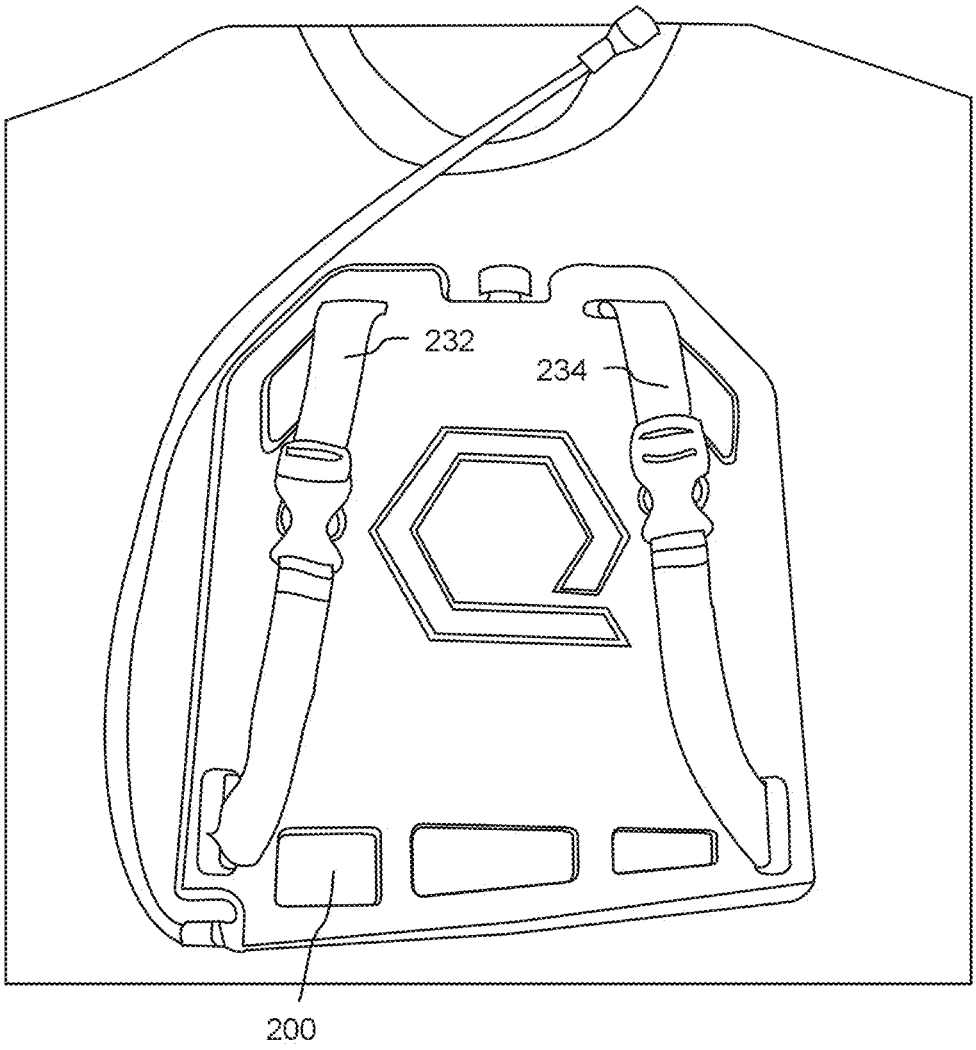

FIGS. 9C and 9D illustrate another strap system 230 comprising two adjustable straps 232, 234. The straps 232, 234 can be inserted through mounting loops 208 formed within the body of the container 200 (or through attachment points 126, 128 as shown in FIG. 6). The ends of the straps 232, 234 (not shown) can include male/female connectors allowing the straps to be opened, removed and replaced.

Figure 10A:
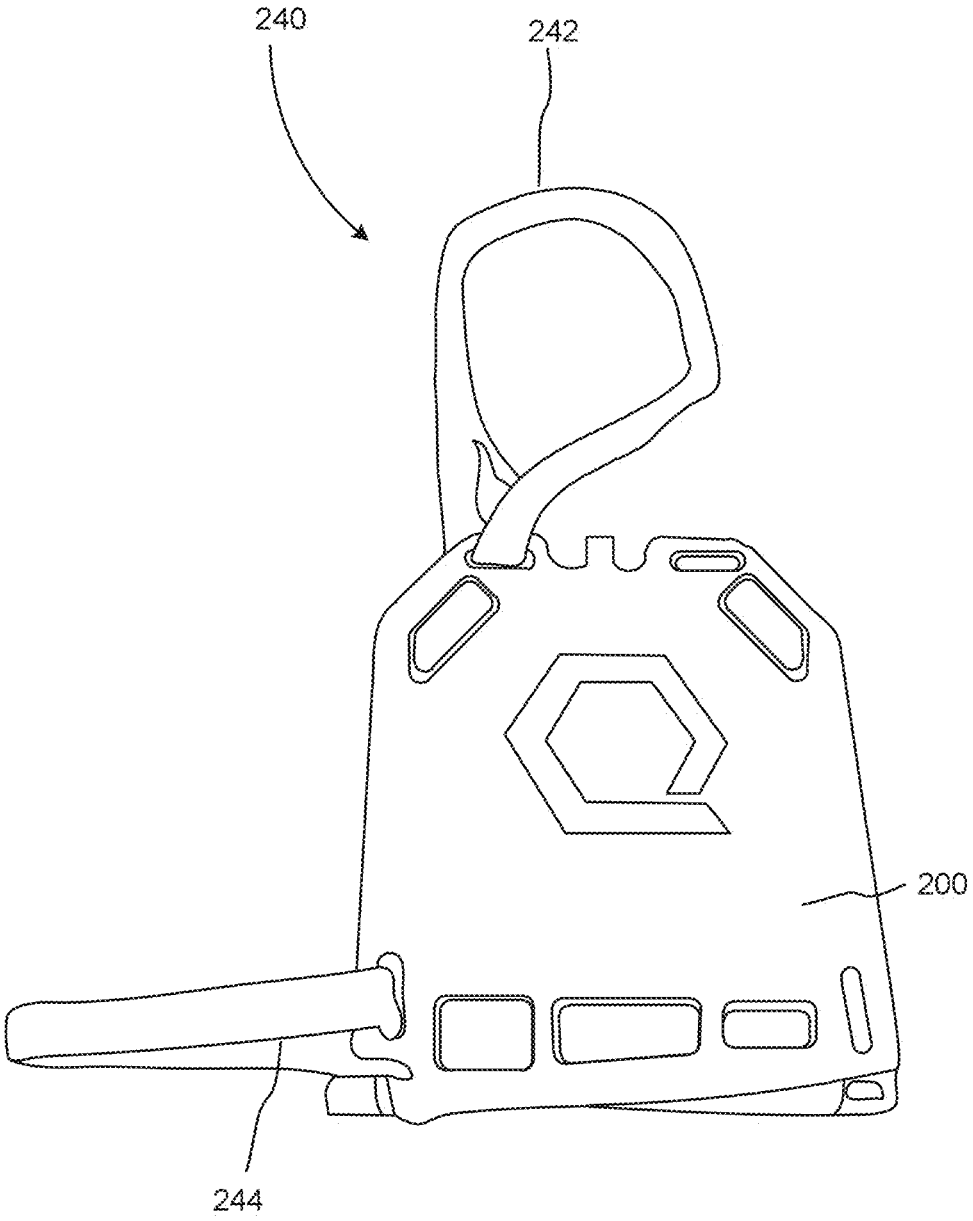
FIGS. 10A-10B illustrates example straps for holding a container constructed in accordance with an embodiment disclosed herein.
Figure 10B:
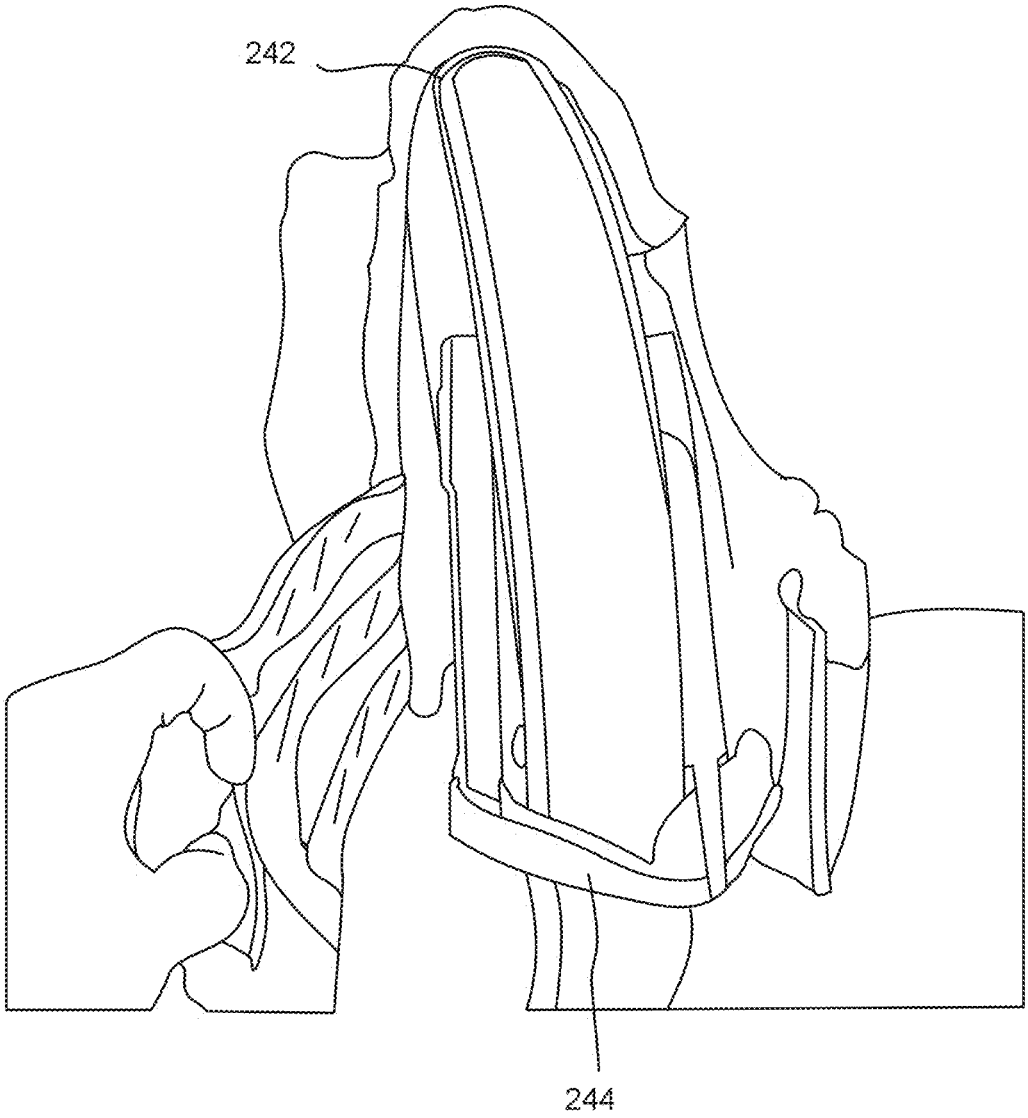
Figure 11:
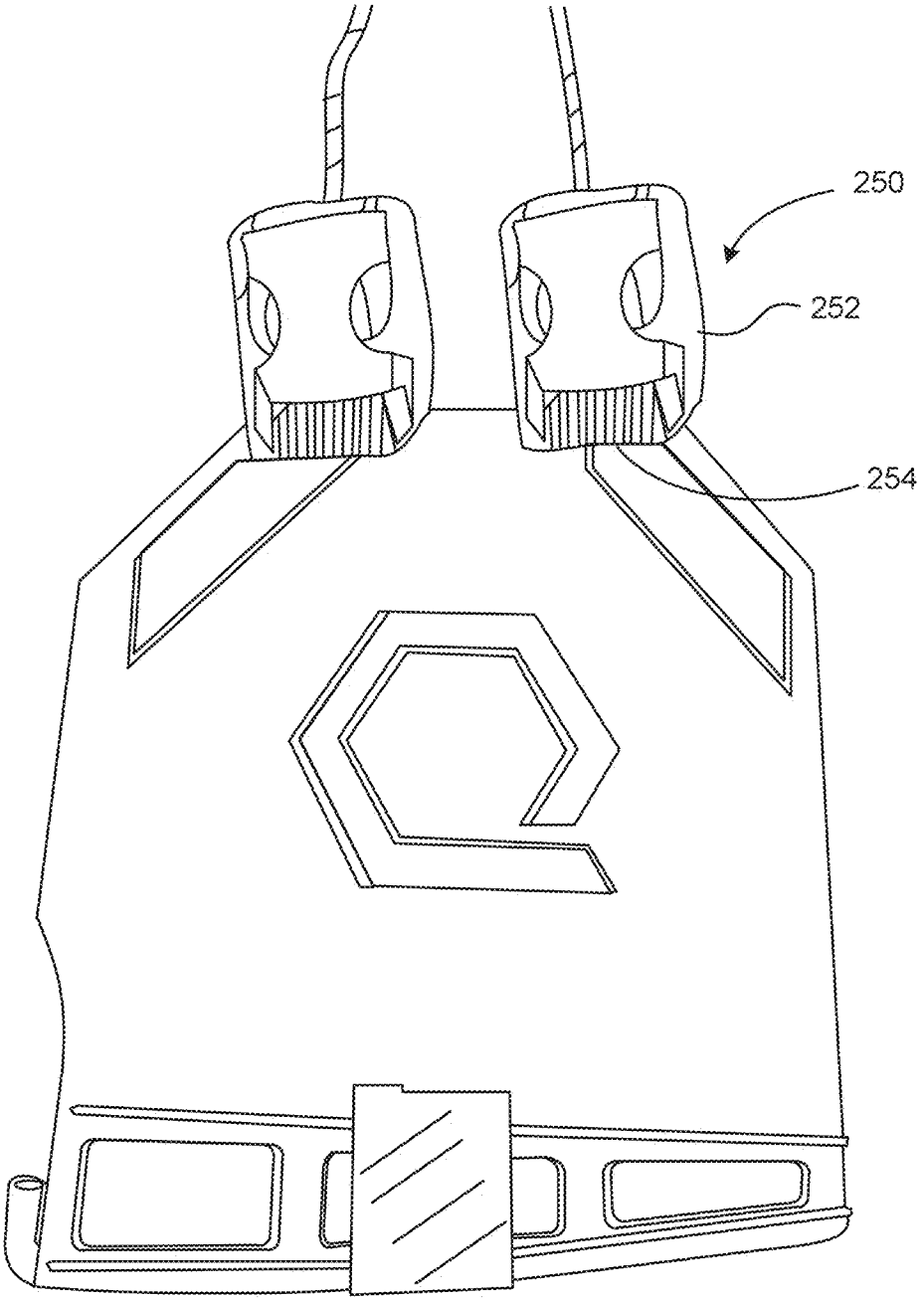
FIG. 11 illustrates an example quick disconnect system for holding a container constructed in accordance with an embodiment disclosed herein.

FIGS. 10A and 10B illustrate another example set of straps 242, 244 forming a strap system 240 for holding a container (e.g., container 200) constructed in accordance with the principles disclosed herein to a user's body. The straps 242, 244 could be attached to or looped through the container 200 and then wrapped around the user's waist or over their shoulders to promote secure placement and wearability or to connect and secure multiple wearable containers, for example, on the user's front and back. As with other embodiments disclosed herein, the strap system 240 is not to be limited to the example shown in FIG. 10. Likewise, the ends of the straps 242, 244 (not shown) can include male/female connectors allowing the straps to be opened, removed and replaced FIG. 11 illustrates an example quick disconnect system 250 for holding a container constructed in accordance with an embodiment disclosed herein to a user's body. Male or female connectors 254 could be molded or otherwise integrally built into the container in addition to or in lieu of the aforementioned integrated strap loops. An opposite connector 252 (i.e., male-female, female-male, opposite magnetic polarity, etc.) would then be attached to the user's apparel (vest, body armor, etc.) such that the user can quickly and easily use the two connectors 252, 254 to securely attach the container to the adjacent apparel. In an alternate embodiment, the connectors could be attached to the container or apparel via webbing, straps, or other fixture allowing a simple retrofit to add the quick disconnect system to existing apparel, vests, or body armor.

Although not shown, it should be appreciated that a dedicated carrier or vest could be used to carry a container disclosed herein. For example, modified versions of uniform or equipment (armor, safety vests, etc.) can be produced to hold a container (without modification to the container), via an added pocket, sleeve, elastic or other similar mechanism.

Figure 12:
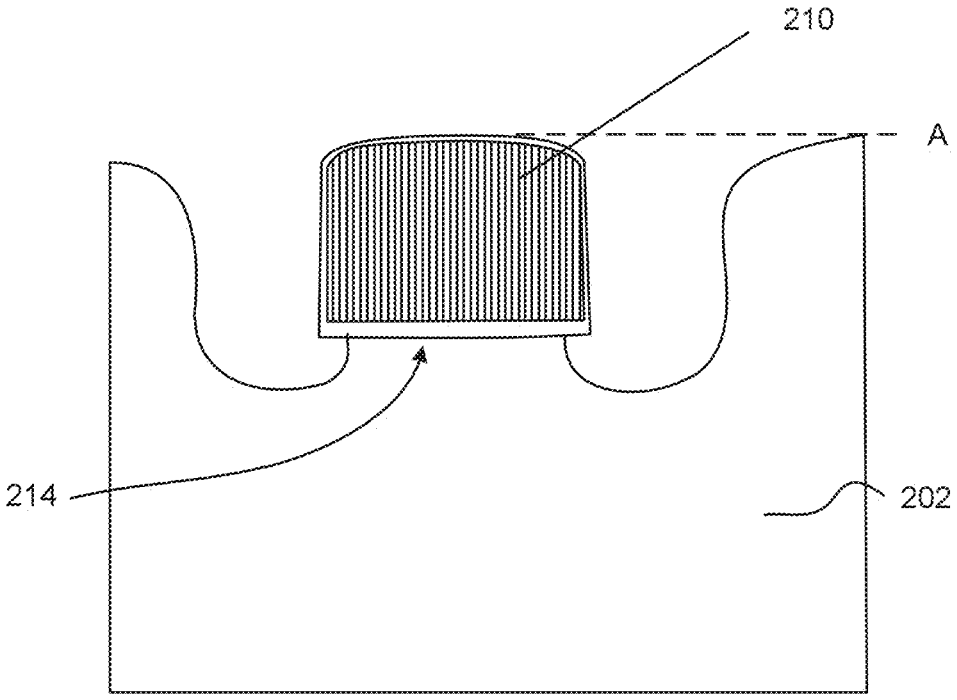
FIG. 12 illustrates a detailed view of an example recessed and armored cap portion for the container illustrated in FIGS. 8A-8B.

FIG. 12 illustrates an example recessed and armored cap portion for the container 200 illustrated in FIGS. 8A-8B. That is, in the illustrated embodiment, the container 200 has a fill port 214 with its top sitting flush with the edge of the container 200 (as shown by dashed line A). By recessing the port 214 and therefore the cap 210 the top of the port and cap sit flush with the adjacent edges, and thus the container 200 profile is lessened, meaning that the user is protected from impalement or acute impact should the container be exposed to severe blast, shock waves, or other abrupt jarring motion that dislodges it from its seated position. The embodiment shown in FIG. 12 would, for example, reduce impact risk to the trachea/windpipe and head area. This configuration also reduces the risk of damage to the fill opening 214 of the container 200 from impacts or from drops.

Figure 13A:
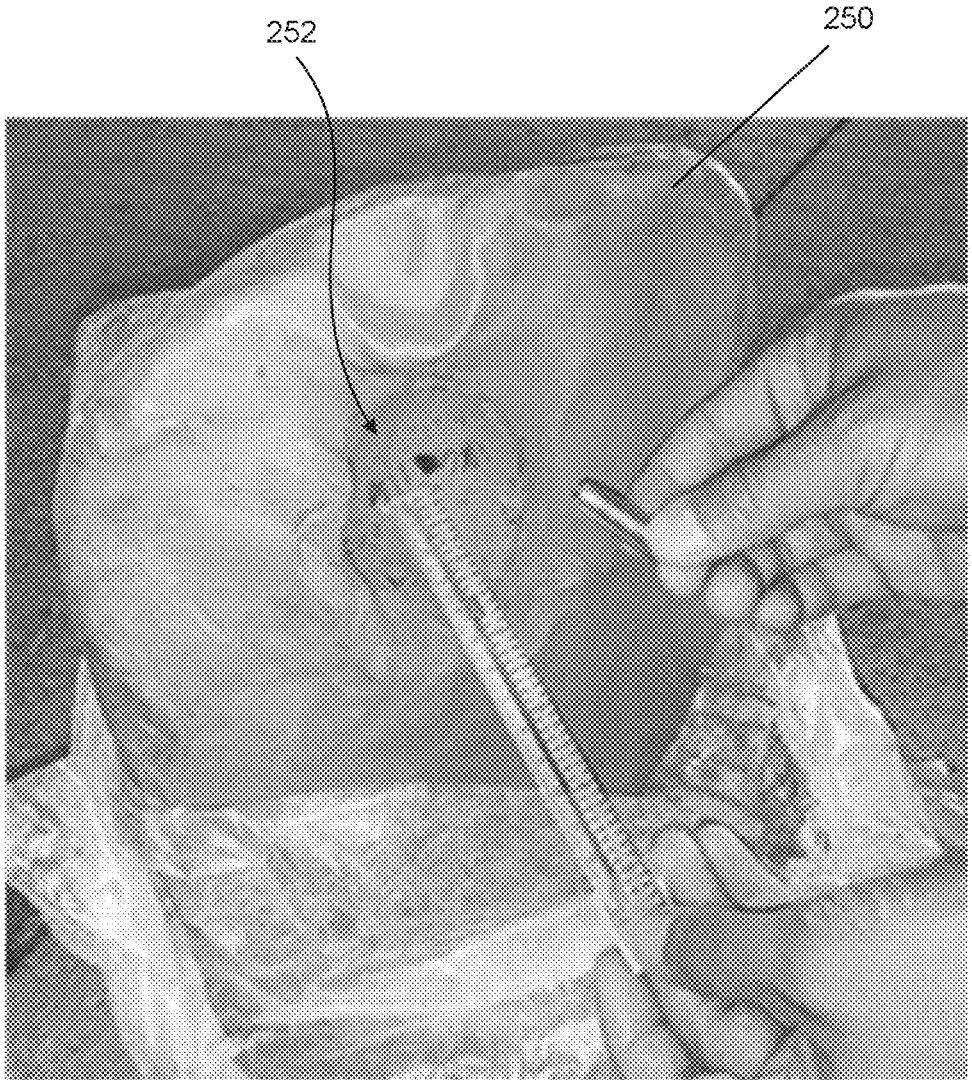
FIGS. 13A-13B illustrate results of a ballistic test performed on body armor with and without use of a container disclosed herein.
Figure 13B:
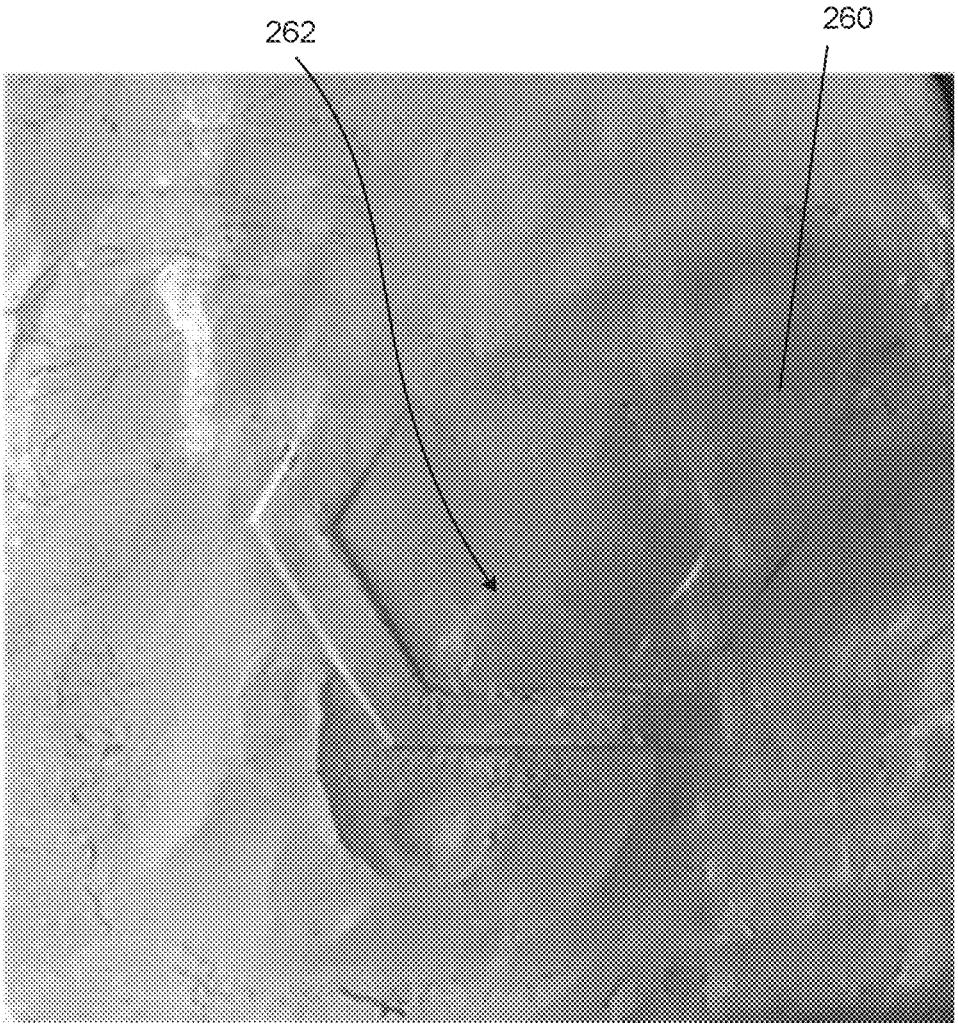

FIGS. 13A-13B illustrate results of a ballistic test performed on body armor with and without use of a container disclosed herein. An embodiment of the container that improves impact and/or ballistic protection is desirable for all users, with ballistic protection of particular interest to body armor users. To test and demonstrate this capability, the container 200 illustrated in FIGS. 8A-8B was subjected to the following test. Two functionally equivalent folding tables, 29 inches high, were set up 16.4 feet apart from each other. On one table, a 25 pound oil-based smoothed clay block (to simulate human density and clearly measure impact and deformation) was set securely and alternately behind 1) both the disclosed container and PACA Level II Soft Armor and 2) just the PACA Level II Soft Armor. From the center of second table, a trained operator fired various firearms and ammunition from a bench rest.

The shots were fired at pre-determined locations on the body armor corresponding with target areas 1, 2, 3, and 6 in NU Standard-0101.06 "Ballistic Resistance of Body Armor" 2008 edition for level IIA soft armor. After each shot fired, the ensemble was removed from the clay block, deformation of the clay and damage to the armor and container (when applicable) was recorded, and the clay was then reset.

Tests were conducted for four caliber/ammunition combinations as detailed in Table A (below). Equivalent tests were performed both with and without frozen containers (i.e., the container 200 of FIGS. 8A-8B was filled with liquid and frozen for one test, and filled with liquid that was not frozen in another test) between the armor and clay. All results are recorded in Table A.

PACA Level IIA Soft Armor

TABLE A

| Firearm (location) | Ammunition | Container | Maximum Deformation |
|---|---|---|---|
| Gen IV Glock 19 (1) | Speer Gold Dot 9 mm 115 g GDHP | No | 3.9 cm |
| Gen IV Glock 19 (1) | Speer Gold Dot 9 mm 115 g GDHP | Yes | 0.1 cm |
| Gen III Glock 23 (3) | Sellier and Bellot.40 S&W FMJ | No | 5.7 cm |
| Gen III Glock 23 (3) | Sellier and Bellot.40 S&W FMJ | Yes | 0.1 cm |

TABLE A-continued

| Firearm (location) | Ammunition | Container | Maximum Deformation |
|---|---|---|---|
| Springfield 1911 Operator "Long Beach" (6) | Speer Gold Dot.45 230 g GDHP | No | 4.2 cm |
| Springfield 1911 Operator "Long Beach" (6) | Speer Gold Dot.45 230 g GDHP | Yes | 0.3 cm |

In all configurations, the container provided substantial ballistic protection and a significant reduction in backface deformation of the clay block. FIG. 13A illustrates the damage 252 to the clay 250 when a container 200 disclosed herein was not used in the testing. FIG. 13B, on the other hand, shows minimal impact 262 on the clay 260 due to the use of a container 200 disclosed herein. Additionally, in an extreme test above and beyond the NU standard, the ensemble with the disclosed container between the clay and armor was rapidly shot four times consecutively with a round of each ammunition in Table A. Results were consistent with table A, in that there was meaningful and significant reduction in backface deformation and only superficial damage to the container.

Figure 14A:
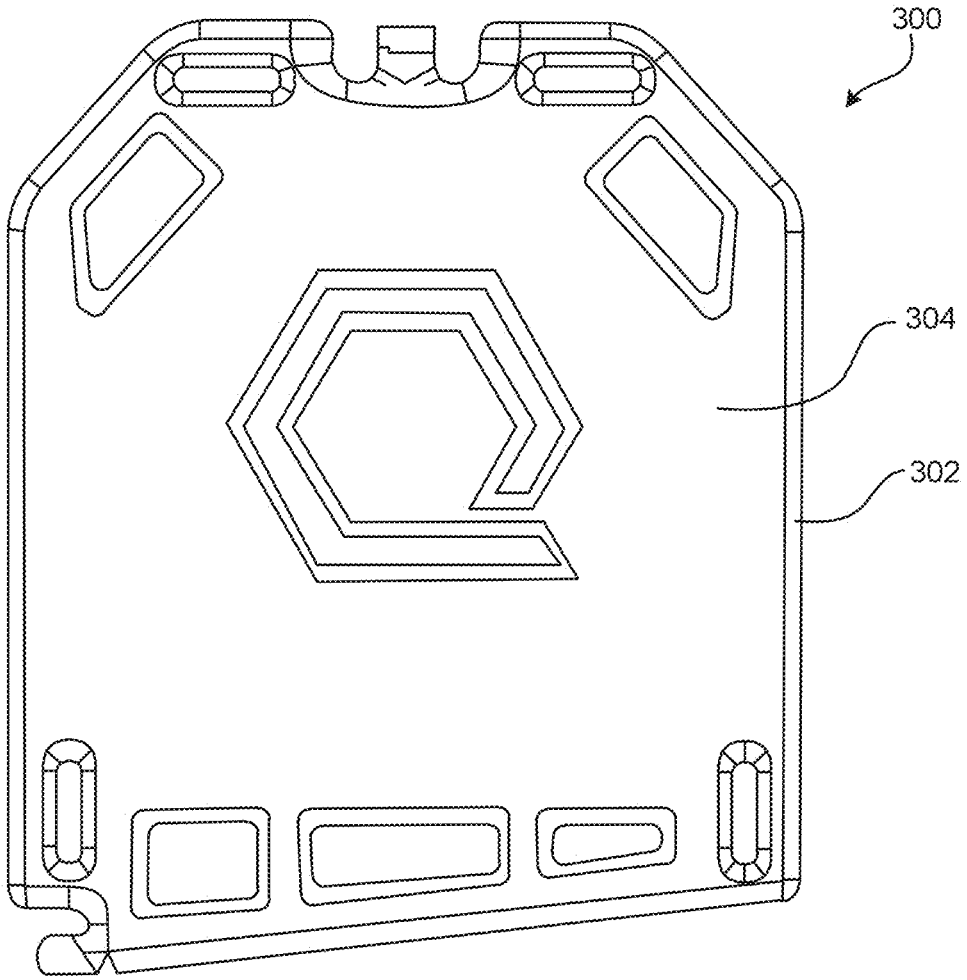
FIGS. 14A-14B illustrate an embodiment of a container disclosed herein that is provided with an armored outward facing plane.
Figure 14B:
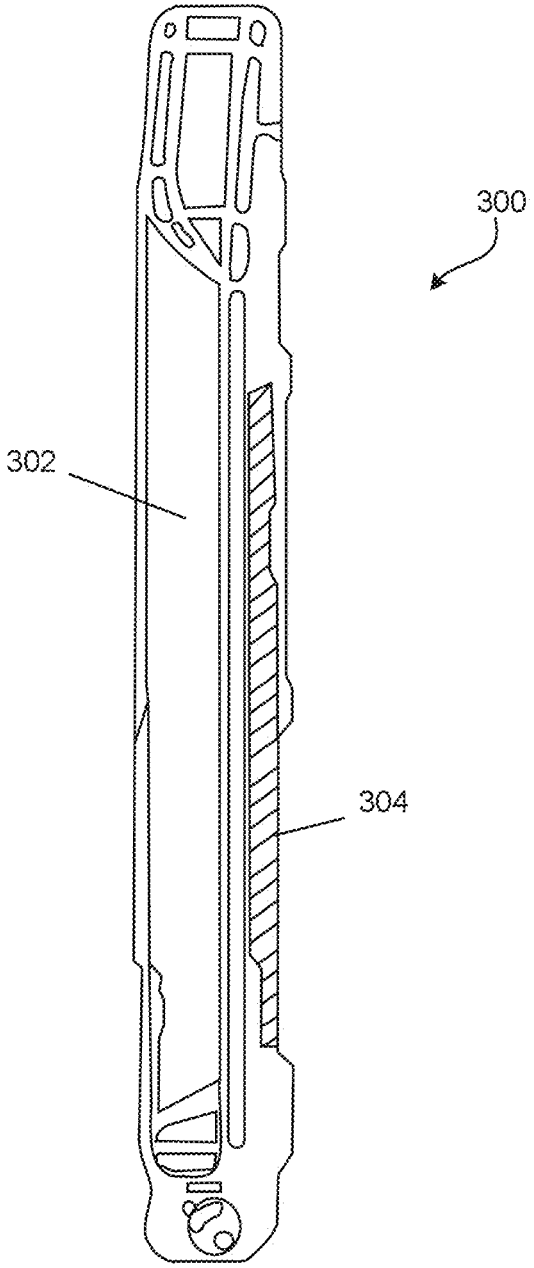

FIGS. 14A and 14B illustrate an embodiment of a container 300 disclosed herein that is provided with an armored outward facing plane 304 on its hollow body 302. As can be appreciated, the illustrated embodiment is designed for and useful for tactical applications such as e.g., military, law enforcement, security. The illustrated embodiment includes a soft, hard, flexible or combined armored surface 304 that serves as the outward facing side of the containers discussed above, particularly those comprising an armor-plate shape. It should be appreciated that any type of armored surface suitable for use in tactical applications can be used. Moreover, the armored surface can be molded as part of the container body 302, inserted into a container body as a carrier vessel and/or attached to the container. Any side of the container could be armored to protect against impacts such as blunt trauma, projectiles (e.g., shrapnel, bullets, Taser prongs, edged weapons, baseballs, batons, human appendages, rockets, bean bags, etc.) or other such threats against which armor is deployed as a protective barrier. The illustrated embodiment retains the liquid storage and transport properties of the container as discussed above and uses them to provide thermoregulation and/or backface deformation protection and hydration in addition to the new and additional armored capabilities.

Figure 15:
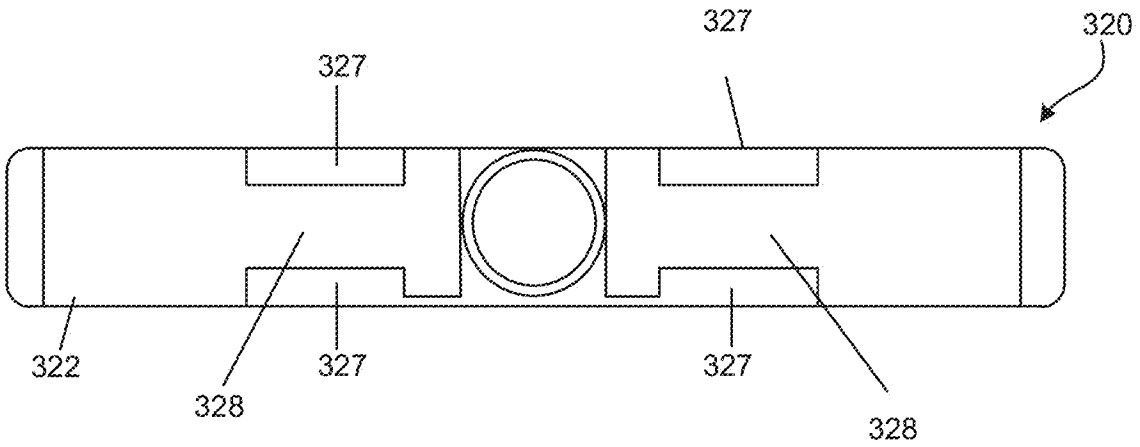
FIG. 15 illustrates another embodiment of the container disclosed herein that is adapted for easier stacking.

FIG. 15 illustrates a top down view of another embodiment of a container 320 disclosed herein that is adapted for easier stacking. A key feature of the disclosed embodiments is the ability to stack them. Stacking allows the disclosed embodiments to store water with greater volumetric efficiency than any other conventional water bottle. However, stacking can be impeded when integrated strap loops are utilized. To ensure that proper stacking may be achieved, the illustrated embodiment uses recessions 327 that have been added to the strap loops 328 on the front and back of the container body 322. These recessions 327 allow straps to clear the lateral planes of the body 322, preventing interference when e.g., the containers 320 are stacked.

Figure 16:
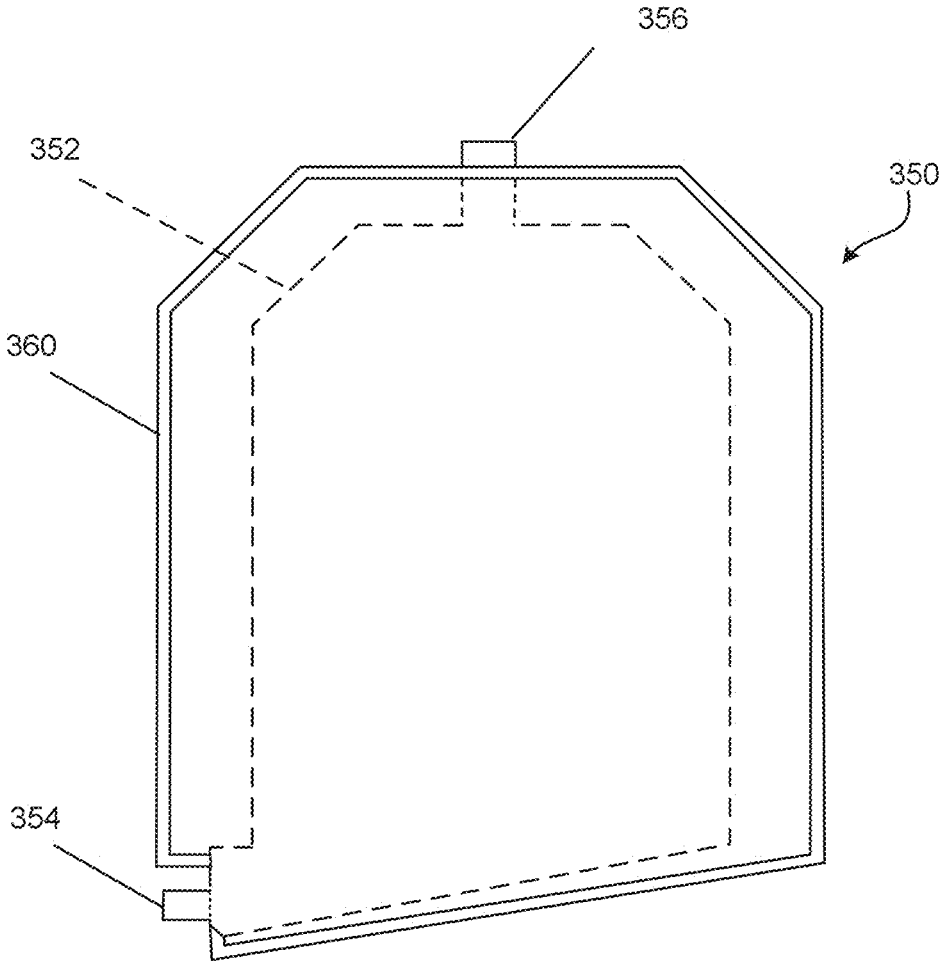
FIG. 16 illustrates an example embodiment of a container with an outer shell of two different layered and coupled materials constructed in accordance with the disclosed principles.

FIG. 16 illustrates an example embodiment of a container 350 with an outer shell of two different layered and coupled materials 352, 360. In one example embodiment, an external armor shell 360 and an internal shell 352 are made of food safe material or insulative material. The inner shell 352 includes a fill port 356 and a drain 354 so that the container 350 would include the functionality and benefits disclosed herein.

Figure 17:
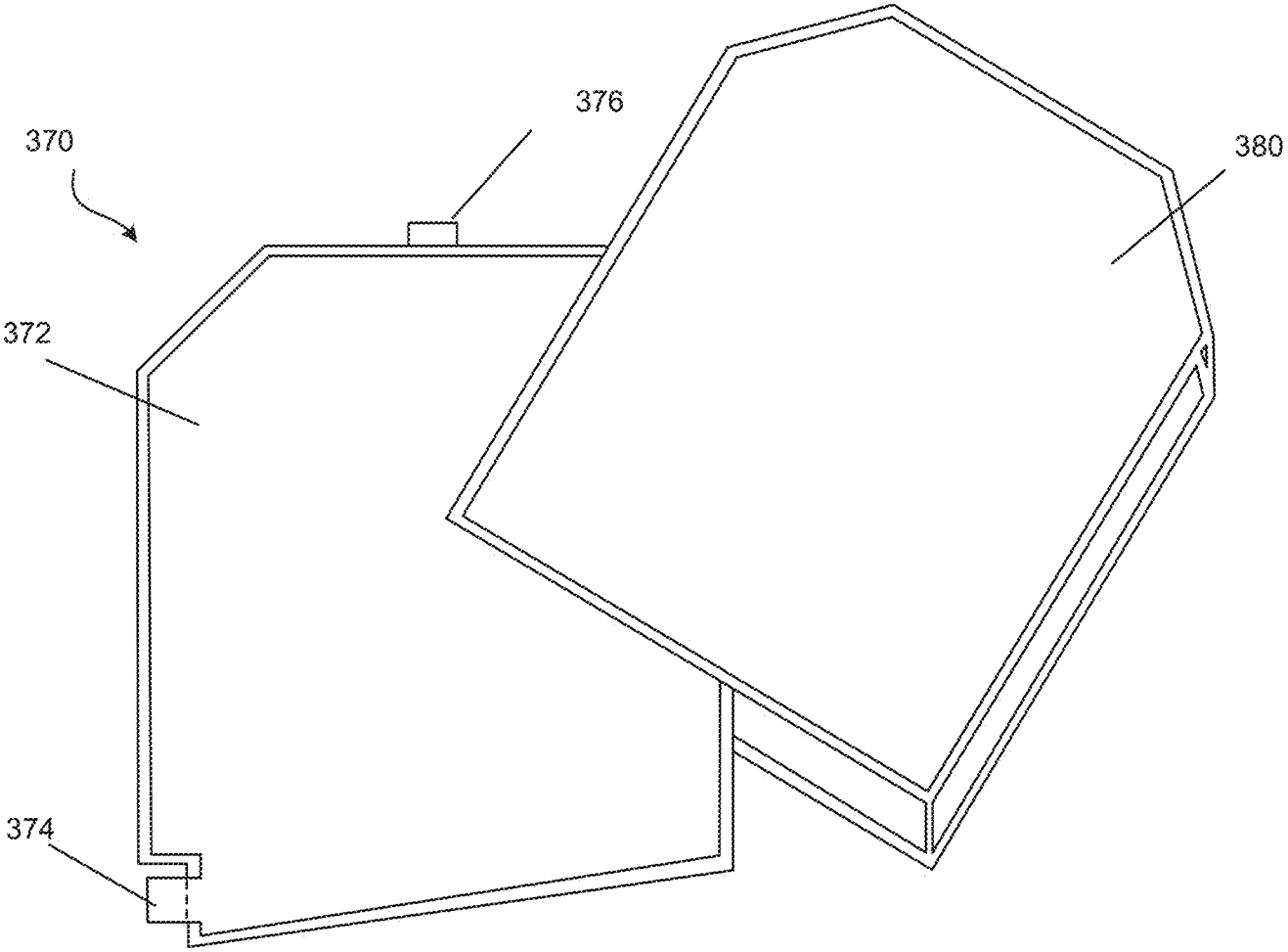
FIG. 17 illustrates an example embodiment of a container with a removable outer shell constructed in accordance with the disclosed principles.

FIG. 17 illustrates an example embodiment of a container 370 with a container body 372 inserted within a removable outer shell 380. The body 372 352 includes a fill port 376 and a drain 374 so that the container 370 would include the functionality and benefits disclosed herein. In the illustrated embodiment, the removable shell 380 could provide additional capability including, but not limited to, impact protection, insulation, liquid absorption, or structure to better fit with gear or to the body contour.

The bladder and containers disclosed herein can be hard or soft sided, constructed from metal, soft or hard plastic (including but not limited to PET, blow molded plastic, injection molded plastic, extruded plastic/polymer, polycarbonate, low density polyethylene, high density polyethylene or other plastic or petrol-derivative), aluminum, steel, foam or other such materials either disposable or reusable in nature. They may also be constructed from multiple layers of various combinations of these materials and need not be in a single piece. Accordingly, the embodiments disclosed herein should not be limited to the type of materials used in their construction.

The embodiments disclosed herein are particularly suited for law enforcement, military, CBRNE, motorsports, mining, construction, cycling and ski/snow environments. It should be appreciated, however, that the disclosed embodiments can be used in any environment where it would be beneficial to cool and/or hydrate the user and/or provide impact protection.

The foregoing examples are provided merely for the purpose of explanation and are in no way to be construed as limiting. While reference to various embodiments is made, the words used herein are words of description and illustration, rather than words of limitation. Further, although reference to particular means, materials, and embodiments are shown, there is no limitation to the particulars disclosed herein. Rather, the embodiments extend to all functionally equivalent structures, methods, and uses, such as are within the scope of the appended claims.

Additionally, the purpose of the Abstract is to enable the patent office and the public generally, and especially the scientists, engineers and practitioners in the art who are not familiar with patent or legal terms or phraseology, to determine quickly from a cursory inspection the nature of the technical disclosure of the application. The Abstract is not intended to be limiting as to the scope of the present inventions in any way.

What is claimed is:

1. A container to be worn by a user, said container comprising:

a hollow body having a shape that substantially matches a profile silhouette of modern military body armor, the hollow body having a front portion, back portion, top portion and bottom portion integrally formed from a same material, the front portion being connected to the back portion by first and second side walls formed between the top and bottom portions, said body having a first port formed out of the bottom portion at a point where a bottom wall of the bottom portion connects to the first side wall and being formed from the same material as the body, said body being adapted to contain a substance for providing thermal regulation to a user's body when the container is adjacent the user's body and for providing hydration when consumed by the user through the first port, the bottom wall extending from a connection to the second side wall and sloping towards the point where the bottom wall connects to the first side wall to facilitate drainage through the first port at a lowest point of the container while being worn; and an attachment mechanism, said mechanism configured to maintain the hollow body in contact with the user's body or clothing such that the substance within the hollow body provides the thermal regulation to the user's body, wherein the front and back portions and the first and second side walls are curved in a same direction between the top and bottom portions providing the container body with a concave contour to facilitate contour matching of the user's body, the first side wall comprising a first upper side wall and a first lower side wall and the second side wall comprising a second upper side wall and a second lower side wall, the first and second upper side walls converge towards each other in an upwards direction of the container, the first and second lower side walls are joined to the first and second opposite upper side walls, respectively, and extend parallel to each other.

2. The container of claim 1, wherein the hollow body further comprises a second port adapted to input the substance.

3. The container of claim 2, further comprising a hose connected to the first port for allowing the user to dispense the substance via the hose.

4. The container of claim 2, wherein the second port is formed at the top portion of the hollow body.

5. The container of claim 1, wherein the hollow body comprises attachment points integrally molded through the hollow body, at least one attachment point being located at the top portion and at least one attachment point being located at the bottom portion.

6. The container of claim 5, wherein the attachment mechanism for securing the container includes one or more straps and the attachment points are adapted to receive the one or more straps.

7. The container of claim 1, further comprising an armored plane attached to one or more portions of the hollow body.

8. The container of claim 1, wherein a positive relief is formed on a first side of the hollow body and a negative relief is formed on a second side of the hollow body, wherein the positive relief is adapted to mate with a negative relief of another container to facilitate stacking or linked storage of multiple containers.

9. The container of claim 1, wherein the front and back portions, the first and second upper side walls, and the first and second lower side walls are curved in a same direction between the top and bottom portions providing the container body with a concave contour to facilitate contour matching of the user's torso.

10. A container to be worn by a user, said container comprising:

a hollow body having a shape that substantially matches a profile silhouette of modern military body armor, the hollow body having a front portion, back portion, top portion and bottom portion integrally formed from a same material, the front portion being connected to the back portion by first and second side walls formed between the top and bottom portions, said body having a surface with an outer edge and a first port formed out of the bottom portion at a point where a bottom wall of the bottom portion connects to the first side wall, the first port being formed from the same material as the body, said body being adapted to contain a substance for providing thermal regulation to a user's body when the container is adjacent the user's body and for providing hydration when consumed by the user through the first port, the bottom wall extending from a connection to the second side wall and sloping towards the point where the bottom wall connects to the first side wall and the first port being formed within a recessed portion of the outer edge where the bottom wall connects to the first side wall such that an outer portion of the first port is below an outer portion of the outer edge, wherein the front and back portions and the first and second side walls are curved in a same direction between the top and bottom portions providing the container body with a concave contour to facilitate contour matching of the user's body, the first side wall comprising a first upper side wall and a first lower side wall and the second side wall comprising a second upper side wall and a second lower side wall, the first and second upper side walls converge towards each other in an upwards direction of the container, the first and second lower side walls are joined to the first and second opposite upper side walls, respectively, and extend parallel to each other.

11. The container of claim 10, further comprising at least one attachment point for receiving a mechanism that maintains the hollow body in contact with the user's body or clothing.

12. The container of claim 11, wherein the mechanism includes at least one strap and the at least one attachment point is adapted to receive the at least one strap.

13. The container of claim 10, wherein the front and back portions, the first and second upper side walls, and the first and second lower side walls are curved in a same direction between the top and bottom portions providing the container body with a concave contour to facilitate contour matching of the user's torso.

14. An apparatus to be worn by a user, said apparatus comprising:

a container body having a shape that substantially matches a profile silhouette of modern military body armor, the container body being adapted to receive and contain a substance for providing thermal regulation to a user's body when the container body is in contact with the user's body or clothing and for providing hydration when consumed by the user, said container body having a front portion, back portion, top portion and bottom portion integrally formed from a same material, the front portion being connected to the back portion by first and second side walls formed between the top and bottom portions, said container body having a first port formed out of the bottom portion at a point where a bottom wall of the bottom portion connects to the first side wall and being formed from the same material as the body, the bottom wall extending from a connection to the second side wall and sloping towards the point where the bottom wall connects to the first side wall to facilitate drainage through the first port at a lowest point of the container while being worn; and a first mechanism configured to hold the container body in contact with the user's body or clothing such that the substance within the container body provides the thermal regulation to the user's body, the first mechanism comprising a strapless sleeve configured to accept and hold the container body, said sleeve being configured to be held on and against a side of the user's body or clothing, wherein the front and back portions and the first and second side walls are curved in a same direction between the top and bottom portions providing the container body with a concave contour to facilitate contour matching of the user's body, the container body comprising first and second opposite upper side walls that converge towards each other in an upwards direction of the container, and first and second opposite lower side walls that are joined to the first and second opposite upper side walls, respectively, and that extend parallel to each other.

15. The apparatus of claim 14, wherein the container body comprises a second port to input the substance and the first port is adapted to output the substance.

16. The apparatus of claim 15, further comprising a hose connected to the first port for allowing the user to dispense the substance via the hose.

17. The apparatus of claim 15, further comprising a hose connected to the first port, said hose comprising a valve for allowing the user to drink the substance via the hose.

18. The apparatus of claim 14, wherein the substance is one of water or ice.

19. The apparatus of claim 14, further comprising an armored plane attached to one or more portions of the container body.

20. The apparatus of claim 14, wherein the front and back portions, the first and second opposite upper side walls, and the first and second opposite lower side walls are curved in a same direction between the top and bottom portions providing the container body with a concave contour to facilitate contour matching of the user's torso.

* * * * *